United States Patent [19]

Phillips

[11] 4,408,977

[45] Oct. 11, 1983

[54] SPINNERET ORIFICE CROSS-SECTIONS

[75] Inventor: Bobby M. Phillips, Kingsport, Tenn.

[73] Assignee: Eastman Kodak Company, Rochester, N.Y.

[21] Appl. No.: 391,082

[22] Filed: Jun. 21, 1982

[51] Int. Cl.[3] ..... D01D 3/00

[52] U.S. Cl. ..... 425/382.2; 264/147; 264/177 F; 425/464; 428/397

[58] Field of Search ..... 428/397; 264/177 F; 425/382.2

[56] References Cited

U.S. PATENT DOCUMENTS

| | | | |
|---|---|---|---|
| 3,109,195 | 11/1963 | Comb et al. | 264/177 F |
| 3,156,607 | 11/1964 | Strachan | 264/177 F |
| 3,981,948 | 9/1976 | Phillips | 264/177 F |
| 4,054,709 | 10/1977 | Belitsin et al. | 264/177 F |
| 4,083,914 | 4/1978 | Shippers | 264/147 |
| 4,316,924 | 2/1982 | Minemura et al. | 428/397 |
| 4,332,761 | 6/1982 | Phillips et al. | 264/177 F |

FOREIGN PATENT DOCUMENTS

| | | | |
|---|---|---|---|
| 145184 | 3/1979 | Fed. Rep. of Germany | 264/177 F |
| 2804376 | 7/1979 | Fed. Rep. of Germany | 264/177 F |
| 1449751 | 8/1966 | France | 264/177 F |
| 1233585 | 5/1971 | United Kingdom . | |
| 675096 | 12/1973 | U.S.S.R. | 264/177 F |
| 644877 | 1/1979 | U.S.S.R. | 264/177 F |

*Primary Examiner*—Jay H. Woo

[57] ABSTRACT

Spinneret orifices the planar cross-section of which defines intersecting quadrilaterals in connected series, the improvement being that one or more of the defined quadrilaterals is or are characterized by its or their width being greater than the width of the remaining quadrilateral(s), with the wider quadrilateral(s) defining body sections and with the remaining quadrilateral(s) defining wing member(s).

10 Claims, 59 Drawing Figures

SPINNERET ORIFICE CROSS-SECTIONS

DESCRIPTION

1. Technical Field

This invention relates to spinneret orifice cross-sections having a special geometry so as to produce novel synthetic filaments in the manner disclosed in copending U.S. patent application Ser. No. (filed herewith), and yarns coming within the scope of U.S. Pat. No. 4,245,001.

2. Background Art

The present invention is directed to a spinneret that defines at least one spinneret orifice the planar cross-section of which defines intersecting quadrilaterals in connected series. The use intended is for melt-spinning filaments and particularly for melt-spinning multifilament, continuous filament yarns that will have a spun-like character or a character similar to that achieved by spinning yarns from staple fibers but without involving all of the operations normally required for spinning yarns from staple fibers.

There are many spinneret orifice cross-sections in the art which can be said to define intersecting quadrilaterals in connected series. A "quadrilateral" is a geometrical plane figure having four sides and four angles. None of these of which I am aware, however, are further characterized in that one or more of such intersecting quadrilaterals have a width greater than the width of the remaining quadrilateral or quadrilaterals or are joined together in such a manner as to produce wing member and body sections.

For instance, in the United Kingdom Pat. No. 1,233,585 published May 26, 1971, the spinneret orifices disclosed are described to be in the form of at least three unbranched linear segments joined end to end, with each adjacent segment intersecting at an angle of from 15° to 170°. In other words each "linear segment" disclosed is rectilinear or "quadrilateral" in configuration, and they are all described to be preferably of uniform width throughout their lengths. The number of such segments is described as varying within a wide range, but for technical reasons is usually from 3 to 10 and preferably from 4 to 10. The terminal linear segments are said to be positioned so that the imaginary rectilinear continuation of the outermost end of each of the two terminal segments will not be directed at any other segments. The purpose of the disclosed spinneret orifice cross-sections is to produce filaments that will more readily crimp after stretching.

In another and related United Kingdom Pat. No. 1,153,543 published May 29, 1969, the disclosed spinneret orifice cross-sections are in the form of a straight central portion each end of which either merges into a curved portion, the curved portions being curved in opposite directions, or is joined to another straight portion which is angled with respect to the central portion. The terminal straight portions are described as pointing in opposite directions. All of the linear segments disclosed are of uniform width, each with respect to the other.

In my U.S. Pat. No. 4,235,574, I disclose a spinneret orifice cross-section the plane of which can be said to show intersecting quadrilaterals, but these are described in the patent as forming an elongated slot and as being a series of repeating "parallelograms" connected in end-to-end relation together and alternating in off-set relation along the major axis of such elongated slot.

Each parallelogram is described as having a pair of opposite side walls "a" substantially parallel to the minor axis of the elongated slot and a pair of opposite side walls "b" substantially parallel to the major axis. A side wall "a" of one parallelogram and the side wall "a" of the adjacent off-set parallelogram lie on a common line and define the angle of the minor axis relative to the major axis of the elongated slot. Filaments spun from this spinneret orifice cross-section, particularly fibers from a polyester polymer such as poly(ethylene terephthalate), will have a undulating cross-section of the nature illustrated in the patents so that the filament or fiber will have improved cover, acceptable glitter and improved aesthetics (soft and cotton-like).

U.S. PAT. NO. 4,245,001

Yarns made from the filament cross-sections spun from the spinneret orifice cross-sections of this invention, and as disclosed in greater detail in U.S. Pat. No. 4,245,001, have a spun yarn character, the yarn comprising a bundle of continuous filaments, the filaments having a continuous body section with at least one wing member extending from and along the body section, the wing member being intermittently separated from the body section, and a fraction of the separated wing members being broken to provide free protruding ends extending from the body section to provide the spun yarn character of the continuous filament yarn. The yarn is further characterized in that portions of the wing member are separated from the body section to form bridge loops, the wing member portion of the bridge loop being attached at each end thereof to the body section, the wing member portion of the bridge loop being shorter in length than the corresponding body section portion.

The free protruding ends extending from the filaments have a mean separation distance along a filament of about one to about ten millimeters and have a mean length of about one to about ten millimeters. The free protruding ends are randomly distributed along the filaments. The probability density function of the lengths of the free protruding ends on each individual filament is defined by $$f(x) = \frac{H(x)}{\int_{o}^{\infty} H(x)dx}, \; x > O, \text{ otherwise } f(x) = O$$

where f(x) is the probability density function $$\text{and } H(x) = \int_{-x}^{+x} \frac{\alpha}{2} e^{-[\alpha \frac{(x+z)}{2} + \frac{2\beta}{(x+z)}]} \cdot R \frac{(x-z)}{2} dz$$

and R(ξ) is the log normal probability density function whose mean is $\mu_2 + \ln w$ and variance is $\sigma_2^2$ or where $\mu_2$=mean value of ln (COT$\theta$) with $\theta$=angle at which tearing break makes to fiber axis and w=width of the wing or $$R(\xi) = \frac{1}{\xi\sigma_2\sqrt{2\pi}} \quad [-\tfrac{1}{2}(\frac{ln\xi - lnw - \mu 2}{\sigma 2})2]$$

and for $\mu_2 = 3.096$

-continued $\sigma_2 = 0.450$
$0.11\ mm^{-1} \leqq \alpha \leqq 2.06\ mm^{-1}$
$0 \leqq \beta \leqq 1.25\ mm^{-1}$
$0.0085\ mm \leqq w \leqq 0.0173\ mm$ The free protruding ends have a preferential direction of protrusion from the individual filaments and greater than 50% of the free protruding ends initially protrude from the body member in the same direction.

The mean length of the wing member portion of the bridge loops is about 0.2 to about 10.0 millimeters and the mean separation distance of the bridge loops along a filament is about 2 to about 50 millimeters. The bridge loops are randomly distributed along the filaments.

The yarns made from filaments spun from the spinneret orifice cross-sections of this invention herein described comprise continuous multifilaments of polyester, polyolefin or polyamide polymer, each having at least one body section and having extending therefrom along its length at least one wing member, the body section comprising about 25 to about 95% of the total mass of the filament and the wing member or wing members comprising about 5 to about 75% of the total mass of the filament, the filament being further characterized by a wing-body interaction (WBI) defined by $$WBI = \left[\frac{(Dmax - Dmin)\,Dmin}{2\,Rc^2}\right]\left[\frac{Lw}{Dmin}\right]^2 \geqq 1$$

where the ratio of the width of the filament cross-section to the wing member thickness ($L_T$/Dmin) is $\leqq 30$.

Dmin is the thickness of the wing member for essentially uniform wing members and the minimum thickness close to the body section when the thickness of the wing member is variable.

Dmax is the thickness or diameter of the body section, as taken generally transversely across the elongated slot.

$L_T$ is the overall length of the filament cross-section.

$L_W$ is the overall length of an individual wing member.

Rc is the radius of curvature of the intersection of the wing member and body section.

The manner of measurement of the above-described parameters is more fully described in U.S. Pat. No. 4,245,001 in which I am one of the coinventors.

The body of each filament remains continuous throughout the fractured yarn and thus provides load-bearing capacity, whereas the wings are broken and provide the free protruding ends.

It should be especially noted that the filament cross-sections disclosed in U.S. Pat. No. 4,245,001 are further characterized by a wing-body interaction defined by $$\left[\frac{(Dmax - Dmin)\,Dmin}{2\,Rc^2}\right]\left[\frac{Lw}{Dmin}\right]^2 \geqq 10$$

where the ratio of the width of the filament to the wing thickness ($L_T$/Dmin) is $\leqq 30$. For reasons given below, it should be noted that the numerical value of WBI $\geqq 10$, as disclosed in U.S. Pat. No. 4,245,001, is different from the numerical value of WBI $\leqq 1$ disclosed herein for the filament cross-sections of the present invention.

Although the fractured yarns made from the filament cross-section spun from the spinneret orifice cross-sections of the present invention come within the scope of the yarn claims in U.S. Pat. No. 4,245,001, the filament cross-sections disclosed herein do not come within the scope of the filament claims in U.S. Pat. No. 4,245,001 because unexpectedly it was found that spinneret orifice cross-sections having the special geometry disclosed herein will spin filament cross-sections that will also give sufficient fracturability so as to produce a desirable level of free protruding ends but with wing-body interaction (WBI) values less than ten.

DISCLOSURE OF INVENTION

In accordance with the present invention, I provide a spinneret defining at least one spinneret orifice the planar cross-section of which defines intersecting quadrilaterals in connected series with the L/W of each quadrilateral varying from 2 to 10, the improvement being that one or more of the defined quadrilaterals is or are characterized by its or their width being greater than the width of the remaining quadrilateral(s), with the wider quadrilateral(s) defining body sections and with the remaining quadrilateral(s) defining wing member(s).

The number of intersecting quadrilaterals may vary from 2 to 14 with the body section quadrilateral(s) varying from 1 to 4 and the wing member quadrilateral(s) varying from 1 to 5.

The number of intersecting quadrilaterals may be 8 with the number of body section quadrilaterals being 2 and the number of wing member quadrilaterals being 3.

The angle $\theta_B$ between adjacent body section quadrilaterals may vary from about 30° to about 90°, and the angle $\theta_W$ between adjacent wing member quadrilaterals may vary from about 45° to about 150°, and the angle $\theta_B$ may vary from about 45° to about 60° and the angle $\theta_W$ may vary from about 45° to about 90°.

The $L_B/W_B$ (length to width, as illustrated in the drawings) of the body section quadrilaterals may vary in proportional relationship from about 1.5 to about 10, and the $L_W/W_W$ (length to width, as also illustrated in the drawings) of the wing member quadrilaterals may vary from about 3 to about 10; and preferably the $L_B/W_B$ may vary in proportional relationship from about 2 to about 5, and the $L_W/W_W$ may vary from about 4 to about 6.

Each end of the corrected series of quadrilaterals in the spinneret orifice defines a circular bore of predetermined diameter, and the diameter D of such circular bore divided by the width of the wing member $W_W$ may vary in proportional relationship from about 1.5 to about 2.5 and preferably may be about 2.

As disclosed in greater detail in my copending U.S. patent application Ser. No. (filed herewith) the spinneret orifice cross-sections spin a filament having a cross-section which has a body section and one or more wing members joined to the body section. The wing members vary up to about twice their minimum thickness along their width. At the junction of the body section and the one or more wing members the respective paired surfaces thereof define a radius of concave curvature (Rc) on one side of the cross-section and a generally convex curve located on the other side of the cross-section generally opposite the radius of curvature (Rc).

The body section constitutes about 25 to about 95% of the total mass of the filament and the wing members constitute about 5 to about 75% of the total mass of the filament, with the filament being further characterized by a wing-body interaction (WBI) defined by $$WBI = \left[ \frac{(D\max - D\min)\, D\min}{2\, Rc^2} \right] \left[ \frac{Lw}{D\min} \right]^2 \geqq 1$$

where the ratio of the width of the filament cross-section to the wing member thickness ($L_T$/Dmin) is $\leqq 30$.

The cross-section of the filament may have a single wing member, or two or more wing members. The filament cross-section may also have one or more wing members that are curved, or the wing member(s) may be angular.

The filament cross-section may also have two wing members and one of the wing members may be non-identical to the other wing member.

The thickness of the wing member(s) may vary up to about twice the minimum thickness and the greater thickness may be along the free edge of the wing member(s). Stated in another manner, a portion of each wing member may be of a greater thickness than the remainder of the wing member.

The periphery of the body section may define one central convex curve on the one side of the cross-section and one central concave curve located on the other side of the cross-section generally opposite the aforementioned at least one central convex curve.

The periphery of the body section may also define on the one side of the filament cross-section at least one central convex curve and at least one central concave curve connected together, and on the other side of the cross-section at least one central concave curve and at least one central convex curve connected together.

The periphery of the body section may further define on the one side of the filament cross-section two central convex curves and a central concave curve connected therebetween and on the other side of the cross-section two central concave curves and a central convex curve connected therebetween.

Each of the one or more wing members may have along the periphery of its cross-section on the one side of the filament cross-section a convex curve joined to the aforementioned radius of concave curvature (Rc) and on the other side of the cross-section a concave curve joined to the first mentioned convex curve that is opposite the radius of concave curvature (Rc).

Each of the one or more wing members may also have along the periphery of the filament cross-section on the one side thereof two or more curves alternating in order of convex to concave with the latter-mentioned convex curve being joined to the aforementioned radius of concave curvature (Rc) and on the other side of the cross-section two or more curves alternating in order of concave to convex with the latter-mentioned concave curve being joined to the first-mentioned convex curve that is opposite the radius of concave curvature (Rc).

The filament cross-section may have four wing members and a portion of the periphery of the body section defines on one side thereof at least one central concave curve and on the opposite side thereof at least one central concave curve, each central concave curve being located generally offset from the other.

The body section of each filament remains continuous throughout the yarn when the yarn is fractured and thus provides load-bearing capacity, whereas the one or more wing members are broken and provide free protruding ends.

BRIEF DESCRIPTION OF DRAWINGS

The details of my invention will be described in connection with the accompanying drawings in which.

BEST MODE FOR CARRYING OUT THE INVENTION

Figure 3:
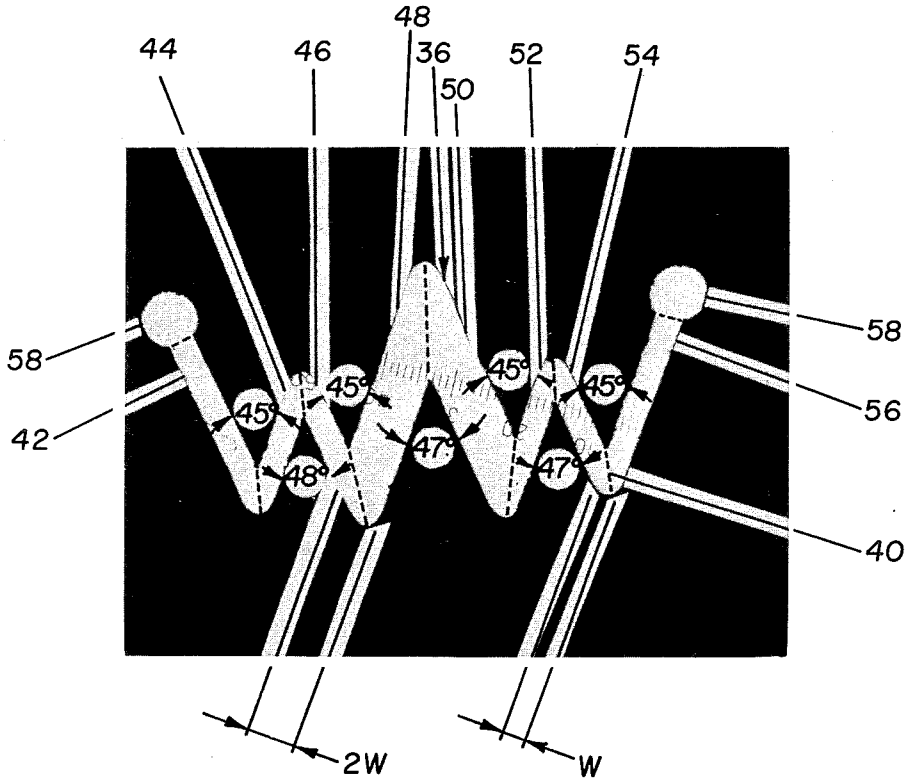
FIG. 3 is a photomicrograph of one embodiment of a spinneret orifice in a spinneret.
Figure 4:
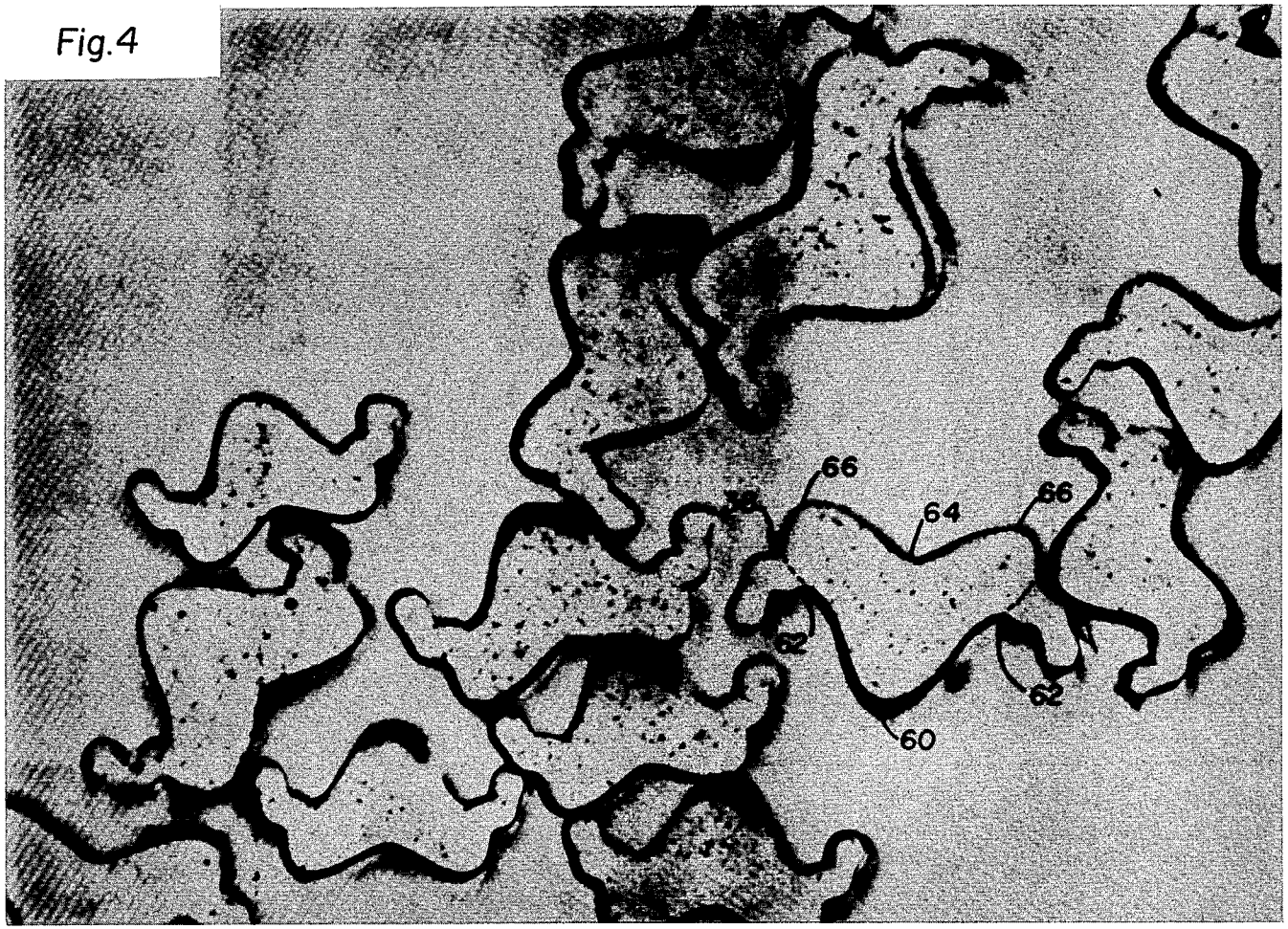
FIG. 4 is a photomicrograph of a filament cross-section of a filament spun from the spinneret orifice shown in FIG. 3.
Figure 5:
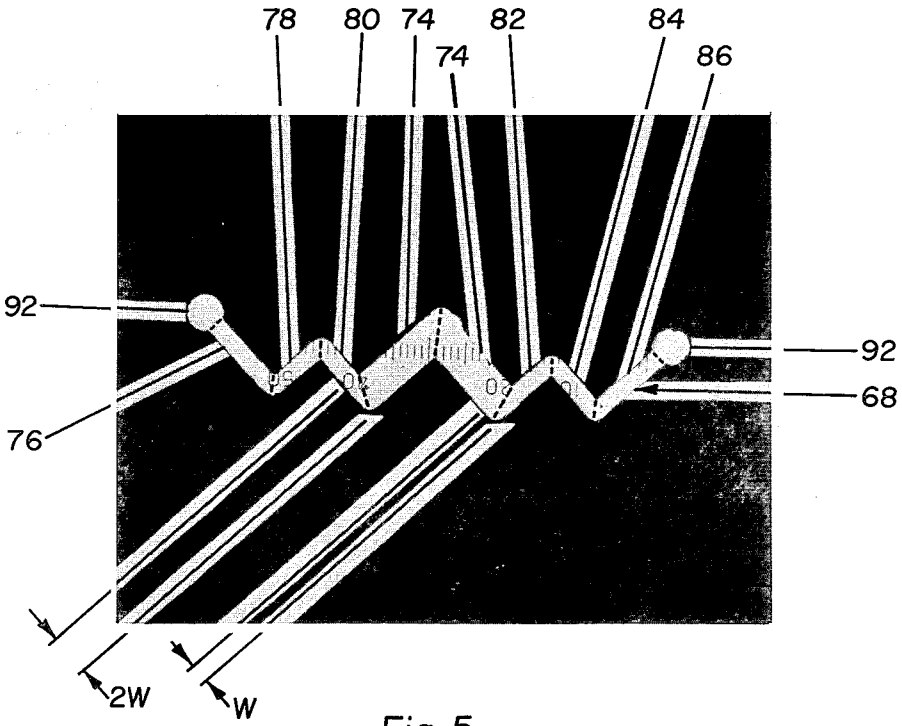
FIG. 5 is a photomicrograph of a second embodiment of a spinneret orifice in a spinneret.
Figure 6:
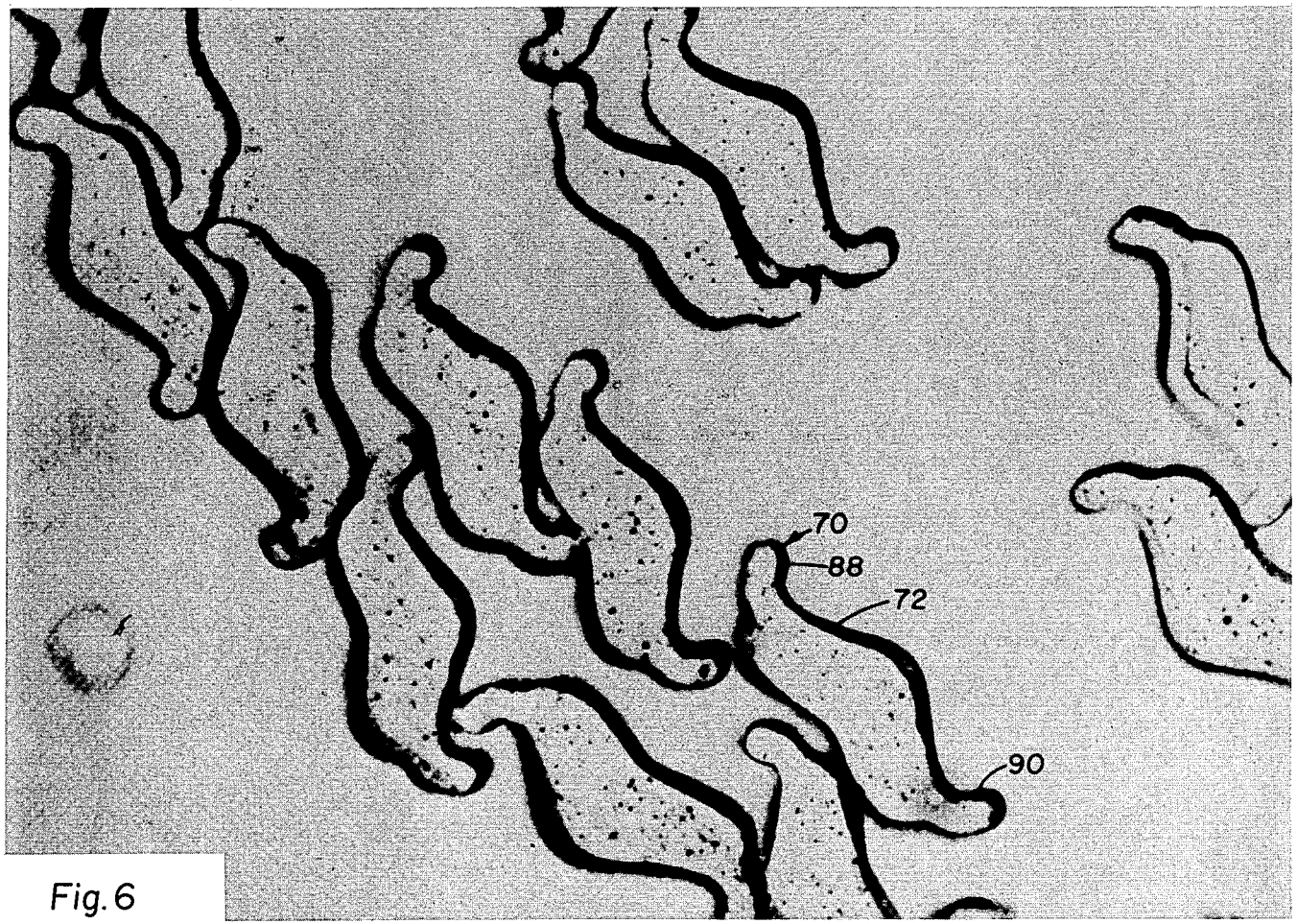
FIG. 6 is a photomicrograph of a filament cross-section of a filament spun from the spinneret orifice shown in FIG. 5.
Figure 7:
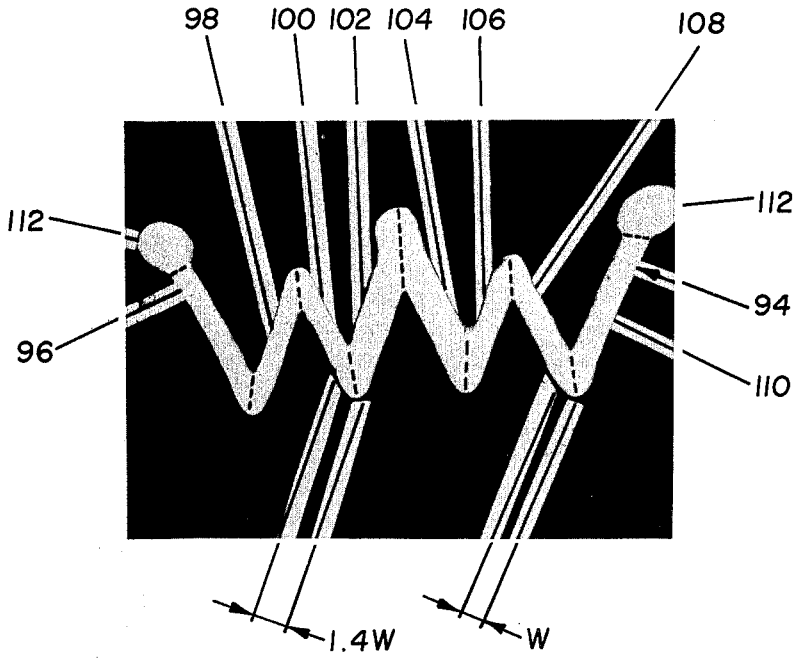
FIG. 7 is a photomicrograph of a third embodiment of a spinneret orifice in a spinneret.
Figure 8:
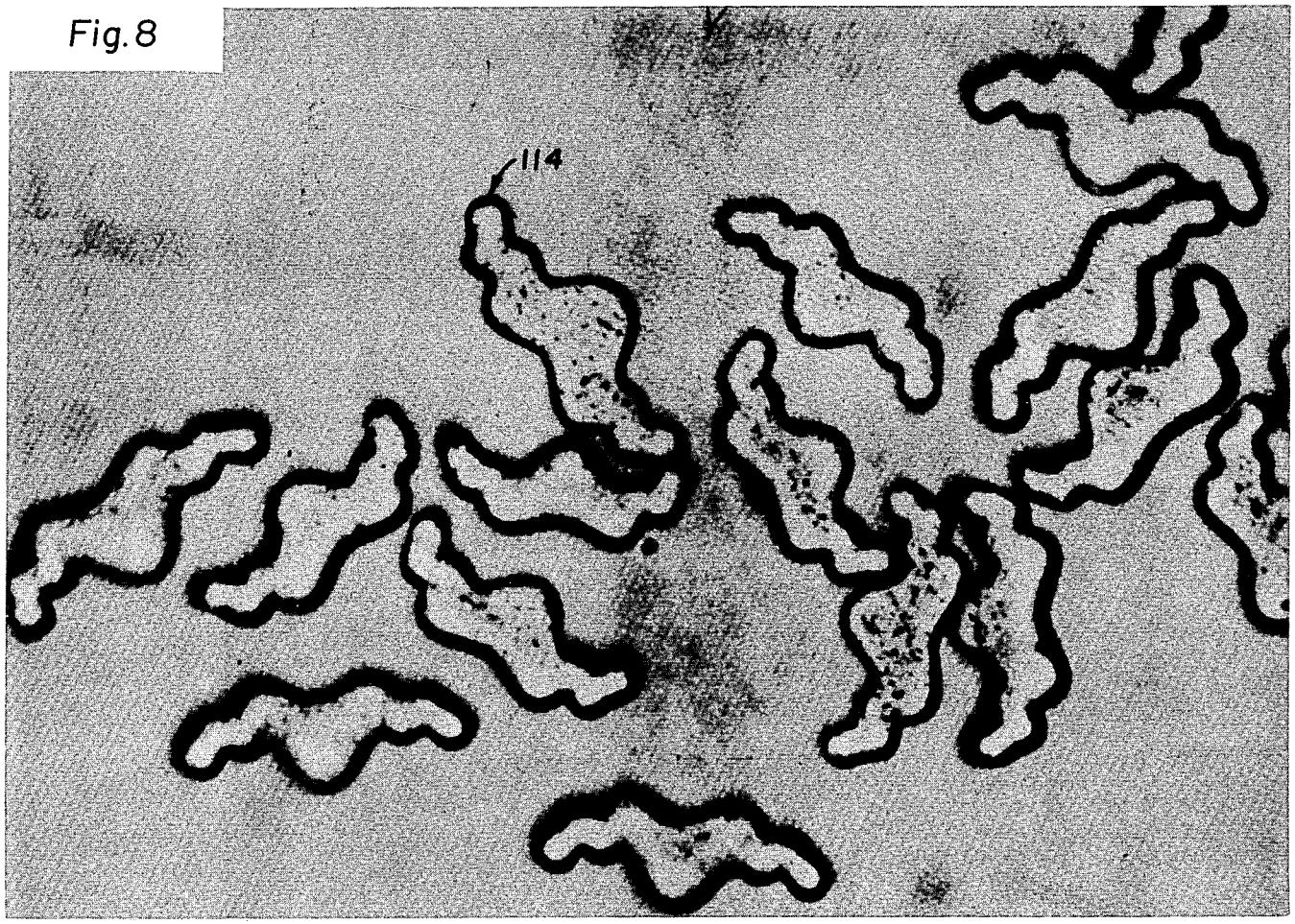
FIG. 8 is a photomicrograph of a filament cross-section of a filament cross-section spun from the spinneret orifice shown in FIG. 7.

In reference to the drawings, I show in FIGS. 3, 5 and 7 photomicrographs of the spinneret orifices of this invention, and in FIGS. 4, 6 and 8 photomicrographs of typical filaments spun from these spinneret orifices. It is critical that the cross-section of the filaments have geometrical features which are further characterized by a wing-body interaction (WBI) defined by $$WBI = \left[\frac{(D\max - D\min)\,D\min}{2\,Rc^2}\right]\left[\frac{Lw}{D\min}\right]^2 \geqq 1$$

where the ratio of the width of the filament cross-section to the wing member thickness ($L_T/D\min$) is $\leqq 30$. The identification of and procedure for measuring these features is described in U.S. Pat. No. 4,245,001 as well as in my copending U.S. Pat. application Ser. No. (filed herewith) mentioned above. It should also be noted that the result of WBI 24 1 above differs from the result of WBI $\geqq 10$ in the patent because the fiber characteristics disclosed in the patent are somewhat different from those disclosed herein.

The spinneret orifice, of course, is the subject of the present invention while the filament cross-section is the subject of a separate invention filed concurrently with the present invention, as previously mentioned. The different spinneret orifices will now be described herein.

The cross-section of each of the spinneret orifices is defined by intersecting quadrilaterals in connected series, as illustrated by the dotted lines in a few of the spinneret orifice drawing figures. Each quadrilateral may be varied in length and width to a predetermined extent, with, of course, each side of the quadrilateral being longer (or shorter) than the corresponding opposite side, and with the angle of such intersection also varying to a predetermined extent in order that the resulting spun filament cross-section will have the necessary wing-body interaction (WBI). A "quadrilateral" is a geometrical plane figure having four sides and four angles, as heretofore mentioned.

Since the spinneret orifices disclosed herein are preferably and more economically formed by a suitable electric discharge machine which operates by an erosion process, the resulting intersecting quadrilaterals will tend to be rounded in the areas as shown, rather than square. If one wanted to form perfectly square corners, at each of quadrilaterals a broach could be used after the electric discharge machine has completed the initial work.

The tips or extrene ends of the connected series of intersecting quadrilaterals are preferably rounded or are in the form of circular bores having a greater diameter than the width of the quadrilateral with which it intersects. The purpose of these circular bores is to promote a greater flow of polymer through the thinner end portions of the spinneret orifices so that the cross-sections of the spinneret orifice will be filled out with polymer during spinning.

Figure 1A:
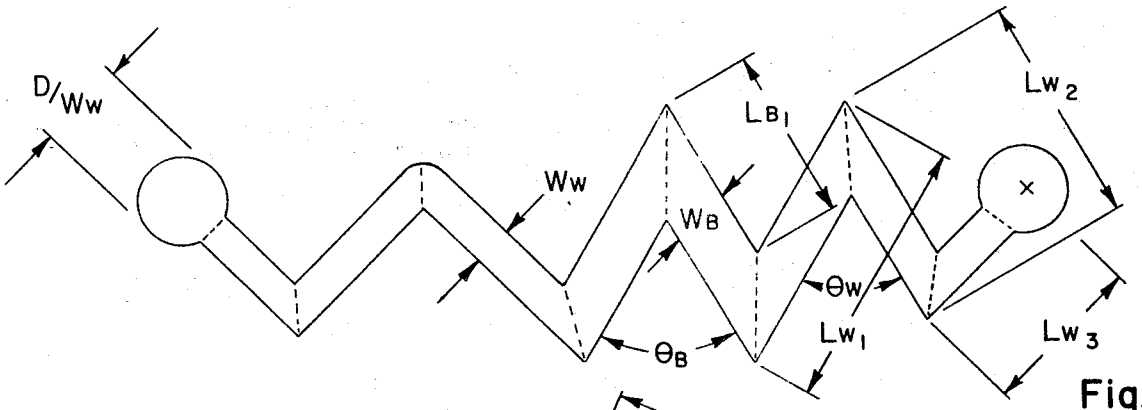
FIGS. 1A and 1B are drawings of representative spinneret orifices showing the nature and location of typical measurements to be made.

More specifically, and with reference to FIG. 1A in the drawings, the planar cross-section of each spinneret orifice defines intersecting quadrilaterals in connected series with the length-to-width ratio (L/W) of each quadrilateral varying from 2 to 10 and with at least one of the intersecting quadrilaterals being characterized as having a width greater than the width of the remaining quadrilateral(s), with the wider quadrilateral(s) defining body sections and with the remaining quadrilateral(s) defining wing member(s).

The number of intersecting quadrilaterals may vary from 5 to 14 and preferably 8; the number of body section quadrilaterals may vary from 1 to 4 and preferably 2; and the number of wing member quadrilaterals for each wing member may vary from 1 to 5 and preferably 3.

The angle $\theta_B$ between adjacent body section quadrilaterals may vary from about 30° to about 90° and preferably from about 45° to about 90°, and the angle $\theta_W$ between adjacent wing member quadrilaterals may vary from about 45° to about 150° and preferably from about 45° to about 90°.

The length-to-width ($L_B/W_B$) of the body section quadrilaterals may vary in proportional relationship from about 1.5 to about 10 and preferably from about 2 to about 5.5, and the length-to-width ($L_W/W_W$) of the wing member quadrilaterals may vary from about 3 to about 10 and preferably from about 4 to about 6.

The diameter (D) of the circular base at the extremities of the spinneret orifice cross-section divided by the width of the wing member ($W_W$) may vary in proportional relationship from about 1.5 to about 2.5 and preferably 2.

Figure 1B:
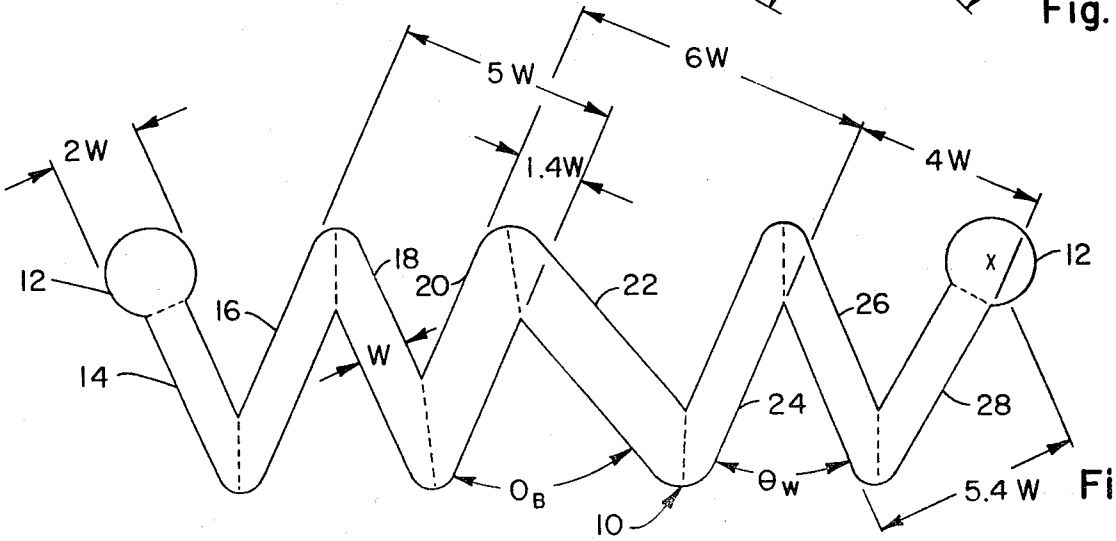
Figures 9, 10:
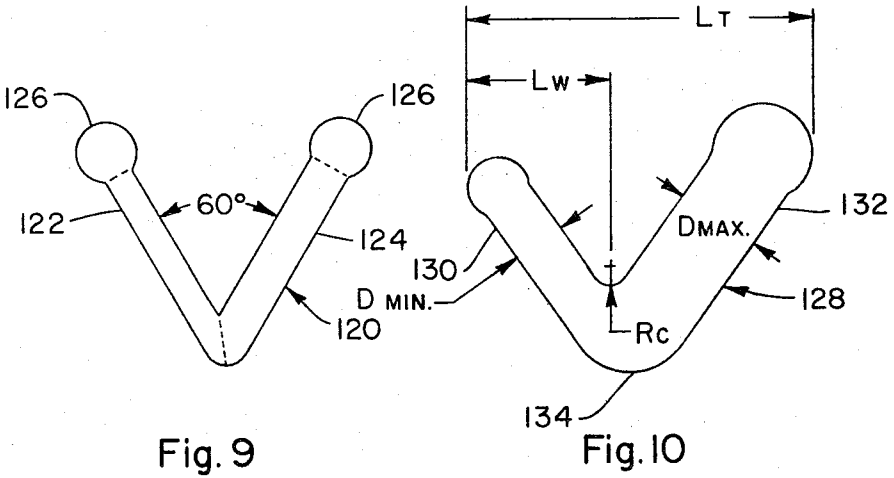
FIG. 9 is a drawing of a spinneret orifice having a single-segment body section and a single-segment wing member having an angle there-between of about 60°.
FIG. 10 illustrates the approximate configuration a filament cross-section will have when spun from the spinneret orifice shown in FIG. 9.

In reference to the drawings, therefore, in FIG. 1B, 10 illustrates a characteristic form that a spinneret orifice cross-section may have to spin the filament cross-section shown. The designated dimensions of the circular bores 12 and the intersecting quadrilaterals 14, 16, 18, 20, 22, 24, 26 and 28 are all normalized to wing member quadrilateral dimension W such that W is always 1. Dimension W should be as small as practical consistent with good spinning practice. For instance, W may be 84 microns, for example. An intersecting quadrilateral for a body section is preferably about 1.4W, as may be observed from FIG. 1B, and the circular bore at the extremities of the spinneret orifice cross-section may preferably be about 2W. The wider quadrilaterals form the body section and the remaining quadrilaterals form the wing members. The different widths illustrated are in proportional relationships to the width W, such as 5W, 6W, etc., as illustrated.

Figure 2:
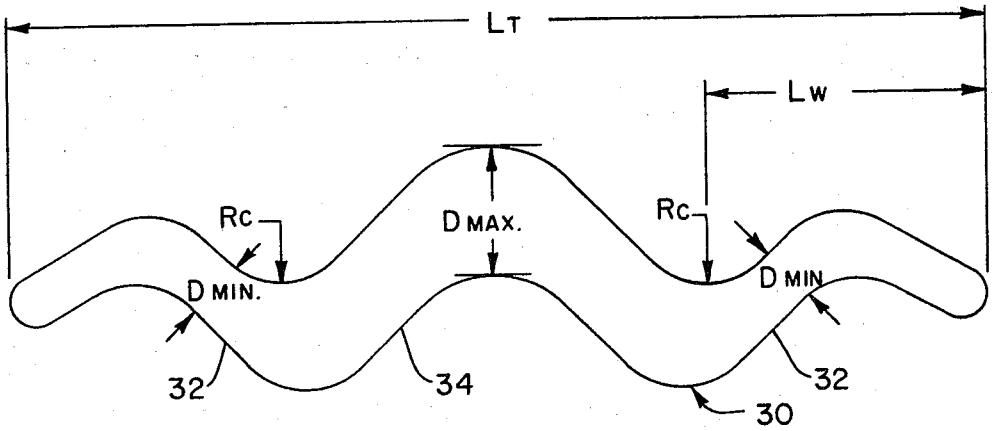
FIG. 2 is a drawing of a representative filament cross-section having a body section and two wing members and showing where the overall length of a wing member cross-section ($L_W$) and the overall or total length of a filament cross-section ($L_T$) are measured, where on the wing member the thickness (Dmin) of the wing member is measured, where on the body section the filament body diameter (Dmax) is measured and the location of the radius of curvature (Rc)

In FIG. 2, 30 illustrates a characteristic form that a filament cross-section may have, showing the approximate locations of the minimum dimension (Dmin) of the wing members 32; the maximum dimension (Dmax) of the body section 34; the radius of curvature ($R_c$) in the area of which fracturing takes place, thereby separating the wing member from the body section; the wing member width ($L_W$); and the width ($L_T$) of the filament cross-section.

In reference now to FIGS. 3 and 4, FIG. 3 shows a photomicrograph of a spinneret orifice planar cross-section 36 and FIG. 4 shows a photomicrograph of a filament cross-section 38 that is spun from the spinneret orifice cross-section shown in FIG. 3. The intersections of the quadrilaterals are represented by dotted lines, such as shown at 40. The planar cross-section is thus defined by intersecting quadrilaterals 42, 44, 46, 48, 50, 52, 54 and 56, with quadrilaterals 48 and 50 being wider than the others and thus representing the body intersecting quadrilaterals, while the others represent the wing member intersecting quadrilaterals. The extremities of the spinneret cross-section are defined by circular bores 58. The width of each body section quadrilateral 48, 50 is 2W, as shown, while the wing member quadrilateral is W.

In the filament cross-section 38 shown in FIG. 4, it will be observed that there are a number of concave and convex curves along the periphery of the cross-section, such as a rather central appearing convex curve 60 which is flanked on either side by a concave curvature 62 and is positioned generally opposite a central appearing concave curve 64, the latter in turn having adjacent on either side convex curves 66. These curves, and the others shown but not specifically designated, bear a one-for-one correspondence with the number of quadrilateral intersections in the spinneret orifice cross-section 36. The size of the curves is dependent upon whether they were spun from the body section or wing member quadrilaterals, the length and width of the quadrilaterals and the angles between adjacent intersecting quadrilaterals of the spinneret orifice cross-section. The body section of the filament cross-section essentially is outlined in part by the central appearing convex curve 60, the oppositely located concave curve 64 and its adjacent convex curves 66. The concave curves 62 form the radius of curvatures (Rc) which join the wing members to the body section.

When polymer is spun from the spinneret orifice cross-section 36, for instance, there is a greater mass of flow through the body section than the wing member portions so that the body section polymer is flowing faster than the wing member polymer. As the body section polymer and wing member polymer begin to equalize, the wing member polymer speeds up while the body section polymer slows down with the results that the body section tends to expand while the wing members tend to contract. Hence, also, the angles in the filament cross-section tend to open out slightly over the angles shown in the spinneret cross-section orifice. For instance, the angle $\theta_W$ between intersecting quadrilaterals 42 and 44 is about 45°; between intersecting quadrilaterals 44 and 46 is about 48°; between intersecting quadrilaterals 46 and 48 is about 45°; between intersecting quadrilaterals 50 and 52 is about 45°; between intersecting quadrilaterals 52 and 54 is about 47°; and between intersecting quadrilaterals 54 and 56 is about 45°. The angle $\theta_B$ between intersecting quadrilaterals 48 and 50 is about 47°.

The spinneret orifice cross-section 68 in FIG. 5 and the filament cross-section 70 in FIG. 6 more graphically illustrate the expansion of the resulting body section of the filament cross-section and the contraction of the wing member portion of the filament cross-section. Note the appearance of the length of the body section 72 in FIG. 6 by comparison to the length of expanse across the larger intersecting quadrilaterals 74 in FIG. 5, whereas the longer-appearing expanse of length across the wing member quadrilaterals 76, 78, 80 or 82, 84, 86 in FIG. 5 result in shorter-appearing wing members 88 or 90 in the filament cross-section 70 shown in FIG. 6. The width of each body section quadrilateral 74 is 2W, as shown in FIG. 5. The extremities of the spinneret cross-section are defined by circular bores 92.

The spinneret orifice cross-section 94 in FIG. 7 has intersecting quadrilaterals 96, 98, 100, 102, 104, 106, 108 and 110, with the wider intersecting quadrilaterals 102 and 104 designating the body section quadrilaterals while the others designated wing members intersecting quadrilaterals. The width of the body section quadrilaterals is 1.4W, as shown. The extremities of the spinneret orifice cross-section are defined by bores 112, which have a diameter of about 2W.

It will be noted in FIG. 7 that the width of the two body section intersecting quadrilaterals 102, 104 is somewhat irregular near their intersection. This was due to a defect in the electric erosion process for this particular spinneret and would not be representative of a conventional operating electric erosion process.

FIG. 8 shows the resulting filament cross-section 114 from the spinneret orifice cross-section of FIG. 7. Note the clear definitions of the concave and convex curves, which is due in part to use of a preferred 1.4W body section quadrilateral (FIG. 7). Compare the filament cross-section of FIG. 8 with that of FIG. 4, for instance, where the spinneret body section width is 2W. FIG. 8 reflects more clearly the one-for-one correspondence of the quadrilateral intersections than the filament cross-section of FIG. 4.

SINGLE WING MEMBER

The spinneret orifice cross-section 120 in FIG. 9 has intersecting quadrilaterals 122, 124 with the single wider intersecting quadrilateral 124 forming a single segment body section and the other single intersecting quadrilateral 122 forming a single segment wing member. The two segments have an angle therebetween of about 60°. The width of the body section quadrilateral is about 1.4W while the width of the wing member quadrilateral is W. The extremities of the spinneret orifice cross-section are defined by circular bores 126.

FIG. 10 shows the resulting filament cross-section 128 as spun from the spinneret orifice cross-section of FIG. 9, with the filament cross-section having a single wing member 130, which is connected to the body section 132, and a generally convex curve 134 located on the other side of the filament cross-section generally opposite the illustrated radius of curvature (Rc).

Figure 11:
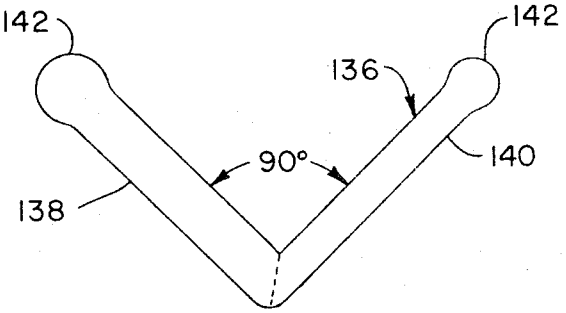
FIG. 11 is a drawing of a spinneret orifice having a single-segment body section and a one-segment single wing member having an angle therebetween of about 90°.

The spinneret orifice cross-section 136 in FIG. 11 has intersecting quadrilaterals 138, 140 with the single wider intersecting quadrilateral 138 also forming a single-segment body section and the other single intersecting quadrilateral 140 also forming a single-segment wing member. The two segments have an angle therebetween of about 90°. The width of the body section quadrilateral is about 1.4W while the width of the wing member quadrilateral is W. The extremities of the spinneret orifice cross-section are defined by circular bores 142.

Figure 12:
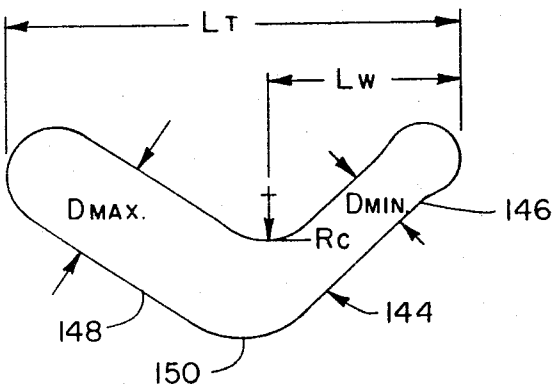
FIG. 12 illustrates the approximate configuration a filament cross-section will have when spun from the spinneret orifice shown in FIG. 11.

FIG. 12 shows the resulting filament cross-section 144 as spun from the spinneret orifice of FIG. 11. This filament cross-section also has a single wing member 146 which is connected to the body section 148, and a generally convex curve 150 located on the other side of the filament cross-section generally opposite radius of curvature (Rc).

Figure 13:
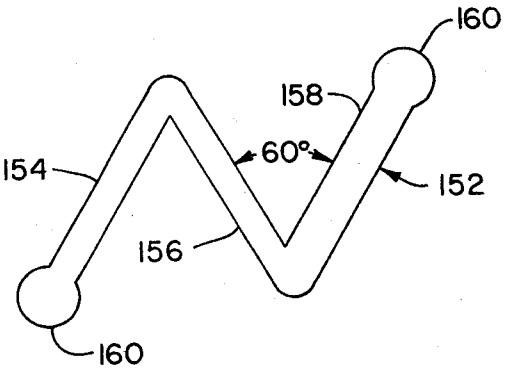
FIG. 13 is a drawing of a spinneret orifice having a single-segment body section and a two-segment single wing member.

The spinneret orifice cross-section 152 in FIG. 13 has intersecting quadrilaterals 154, 156 and 158 with the single wider intersecting quadrilateral 158 forming a single-segment body section and the other two intersecting quadrilaterals 154, 156 forming a two-segment, single-wing member. The angle between the body section and wing member is about 60°. The width of the body section quadrilateral is about 1.4W while the width of the wing member quadrilaterals is W. The extremities of the spinneret orifice cross-section are defined by circular bores 160°.

Figure 14:
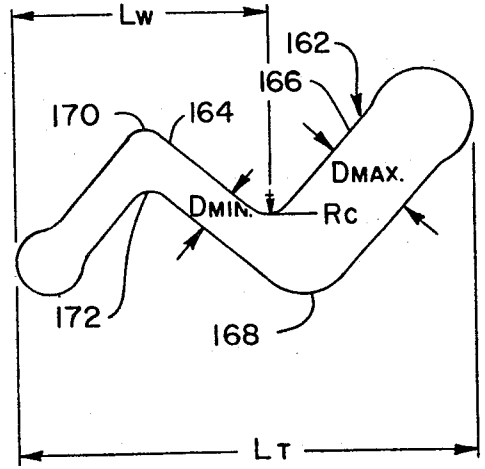
FIG. 14 illustrates the approximate configuration a filament cross-section will have when spun from the spinneret orifice shown in FIG. 13.

FIG. 14 shows the resulting filament cross-section 162 as spun from the spinneret orifice cross-section of FIG. 13, with the filament cross-section having a single wing member 164, which is connected to the body section 166, and a generally convex curve 168 located on the other side of the filament cross-section generally opposite the illustrated radius of curvature (Rc). The single wing member 164 has along its periphery a convex curve 170 located generally opposite a concave curve 172.

Two Wing Members

Figure 15:
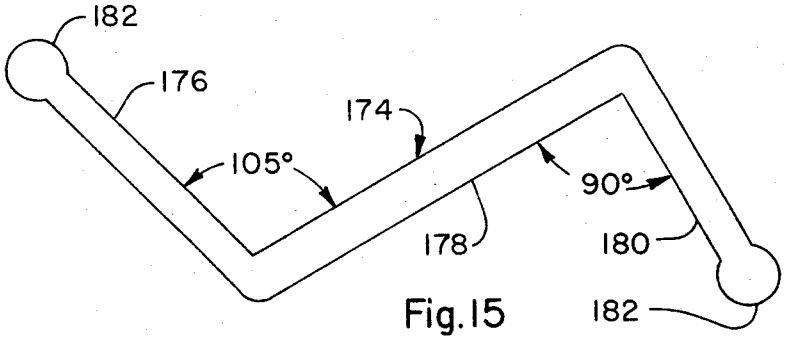
FIG. 15 is a drawing of a spinneret orifice having a single-segment body section and a one-segment wing member intersecting at about 105° at one end of the body section and another one-segment wing member intersecting at about 90° with the other end of the body section, and with the lengths of the wing members differing from each other.

The spinneret orifice cross-section 174 in FIG. 15 has intersecting quadrilaterals 176, 178, 180 with the single wider intersecting quadrilateral 178 forming a single-segment body section and the other single intersecting quadrilaterals 176 and 180 forming two single-segment wing members. The angles between the body section and the wing members are, respectively, about 105° and 90°, as illustrated in FIG. 15. The width of the body section quadrilateral is about 1.4W while the width of the wing member quadrilaterals is W. The extremities of the spinneret orifice cross-section are defined by circular bores 182.

Figure 16:
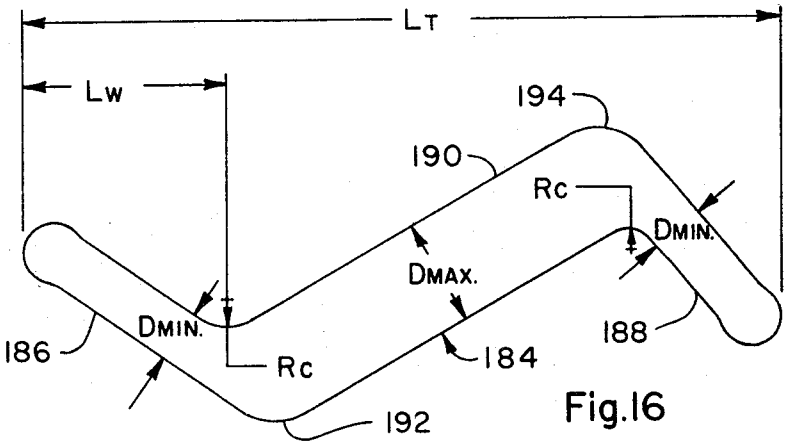
FIG. 16 illustrates the approximate configuration a filament cross-section will have when spun from the spinneret orifice shown in FIG. 15.

FIG. 16 shows the resulting filament cross-section 184 as spun from the spinneret orifice cross-section of FIG. 15, with the filament cross-section having two wing members 186, 188, which are connected, respectively, to an end of the body section 190, and two generally convex curves 192, 194 each located on the other side of the filament cross-section generally oppoosite one of the illustrated radius of curvatures (Rc). Wing member 188 is longer than wing member 186.

Figure 17:
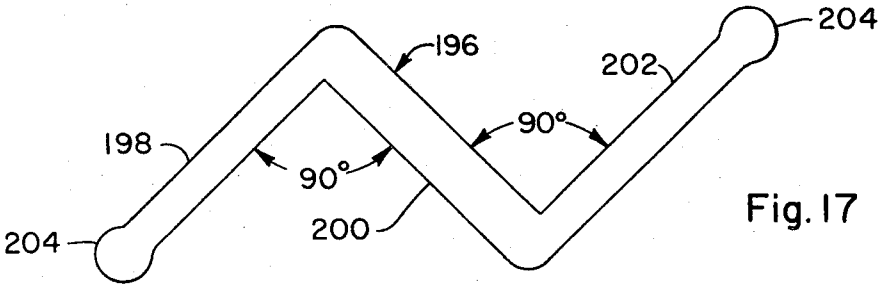
FIG. 17 is a drawing of a spinneret orifice having a single-segment body section and a one-segment wing member intersecting at about 90° at each end of the body section, and with the lengths of the wing members being the same.

The spinneret orifice cross-section 196 in FIG. 17 has intersecting quadrilaterals 198, 200, 202 with the single wider intersecting quadrilateral 200 forming a single-segment body section and the other single intersecting quadrilaterals 198 and 202 also forming two single-segment wing members. The angles between the body section and the wing members are each about 90° as illustrated in FIG. 17. The width of the body section is about 1.4W while the width of the wing member quadilaterals is W. The extremities of the spinneret orifice cross-section are defined by circular bores 204.

Figure 18:
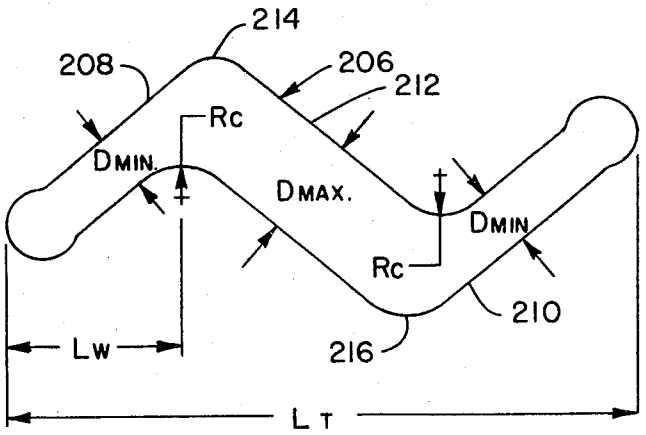
FIG. 18 illustrates the approximate configuration a filament cross-section will have when spun from the spinneret orifice shown in FIG. 17.

FIG. 18 shows the resulting filament cross-section 206, with the filament cross-section having two wing members 208, 210, which are connected, respectively, to an end of the body section 212, and two generally convex curves 214, 216, each located on the other side of the filament cross-section generally opposite one of the illustrated radius of curvatures (Rc).

Figure 19:
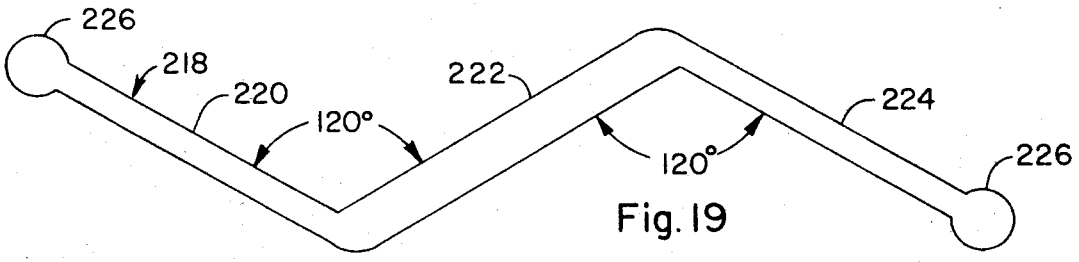
FIG. 19 is a drawing of a spinneret orifice having a single-segment body section and a one-segment wing member intersecting at about 120° at each end of the body section, with each wing member being of the same length as the other.

The spinneret orifice cross-section 218 in FIG. 19 has intersecting quadrilaterals 220, 222, 224 with the single wider intersecting quadrilateral 222 forming a single-segment body section and the other single intersecting quadrilaterals 220 and 224 forming two single-segment wing members. The angles between the body section and the wing members are each about 120° as illustrated in FIG. 19. The width of the body section is about 1.4W while the width of the wing member quadrilaterals is W. The extremities of the spinneret orifice cross-section are defined by circular bores 226.

Figure 20:
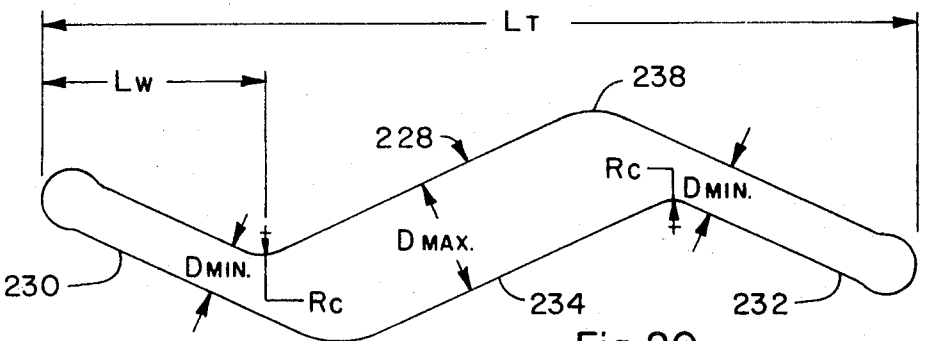
FIG. 20 illustrates the approximate configuration a filament cross-section will have when spun from the spinneret orifice shown in FIG. 19.

FIG. 20 shows the resulting filament cross-section 228, with the filament cross-section having two wing members 230, 232, which are connected, respectively, to an end of the body section 234, and two generally convex curves 236, 238, each located on the other side of the filament cross-section generally opposite one of the illustrated radius of curvatures (Rc).

Figure 21:
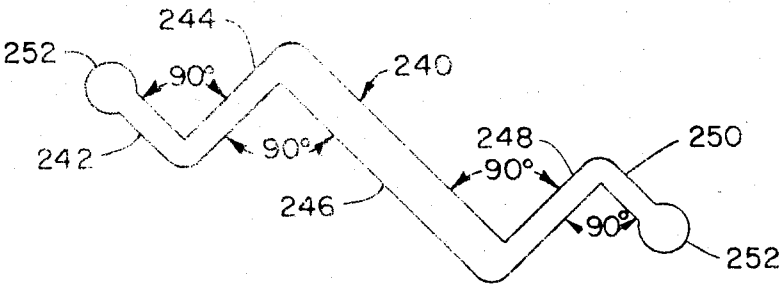
FIG. 21 is a drawing of a spinneret orifice having a single-segment body section and a two-segment wing member intersecting at about 90° with each other and at each end of the body section, with the segments of the wing member at each end of the body section corresponding in length.

The spinneret orifice cross-section 240 in FIG. 21 has intersecting quadrilaterals 242, 244, 246, 248, 250, with the single wider intersecting quadrilateral 246 forming a single-segment body section and the other intersecting quadrilaterals 242, 244 and 248, 250 forming two dual-segment wing members. The angles between the body section and the wing members are each about 90°, as illustrated in FIG. 21, and the angles between the dual segments of each of the wing members are each about 90°, as also illustrated. The width of the body section is about 1.4W while the width of the wing member quadrilaterals is W. The extremities of the spinneret orifice cross-section are defined by circular bores 252.

Figure 22:
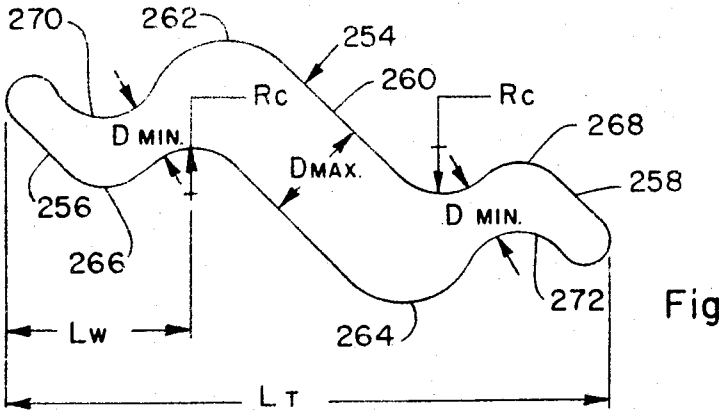
FIG. 22 illustrates the approximate configuration a filament cross-section will have when spun from the spinneret orifice shown in FIG. 21.

FIG. 22 shows the resulting filament cross-section 254, with the filament cross-section having two wing members 256, 258, which are connected, respectively, to an end of the body section 260, and two generally convex curves 262, 264, each located on the other side of the filament cross-section generally opposite one of the illustrated radius of curvatures (Rc).

The dual segmentation of the wing members 256, 258 results in the formation of additional convex curves 266, 268, each of which is located on the other side of the filament cross-section generally opposite, respectively, of concave curves 270, 272. The convex and concave curves mentioned alternate around the periphery of the filament cross-section.

Figure 23:
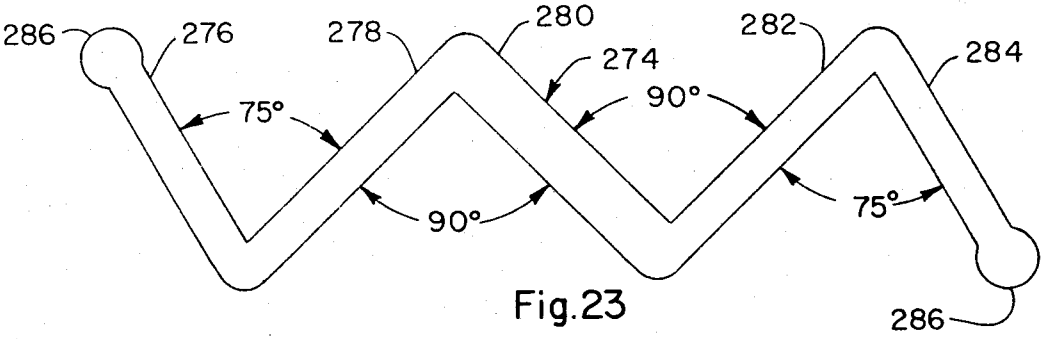
FIG. 23 is a drawing of a spinneret orifice having a single-segment body section and two dual-segment wing members each intersecting with an end of the single-segment body section at about 90° and each segment of the dual-segment wing member intersecting with the other segment at about 75°.

The spinneret orifice cross-section 274 in FIG. 23 has intersecting quadrilaterals 276, 278, 280, 282, 284, with the single wider intersecting quadrilateral 280 forming a single-segment body section and the other intersecting quadrilaterals 276, 278 and 282, 284 also forming two dual-segment wing members. The angles between the body section and the wing members are each about 90°, as illustrated in FIG. 23, and the angles between the dual segments of each of the wing members are each about 75°, as also illustrated. The width of the body section is about 1.4W while the width of the wing member quadrilaterals is W. The extremities of the spinneret orifice are defined by circular bores 286.

Figure 24:
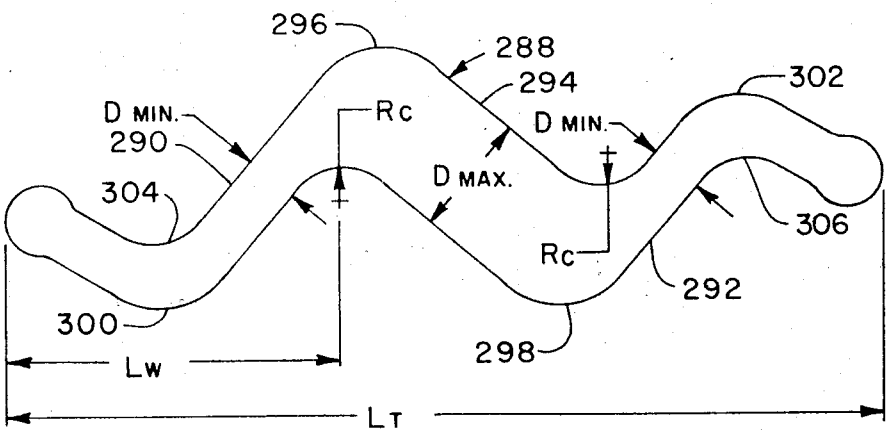
FIG. 24 illustrates the approximate configuration a filament cross-section will have when spun from the spinneret orifice shown in FIG. 23.

FIG. 24 shows the resulting filament cross-section 288, as spun from the spinneret orifice cross-section of FIG. 23, with the filament cross-sections having two wing members 290, 292, which are connected, respectively, to an end of the body section 294, and two generally convex curves 296, 298, each located on the other side of the filament cross-section generally opposite one of the illustrated radius of curvatures (Rc).

The dual segmentation of the wing members 290, 292 also results in the formation of additional convex curves 300, 302, each of which is located on the other side of the filament cross-section generally opposite, respectively, of concave curves 304, 306. The convex and concave curves mentioned alternate around the periphery of the filament cross-section.

Figure 25:
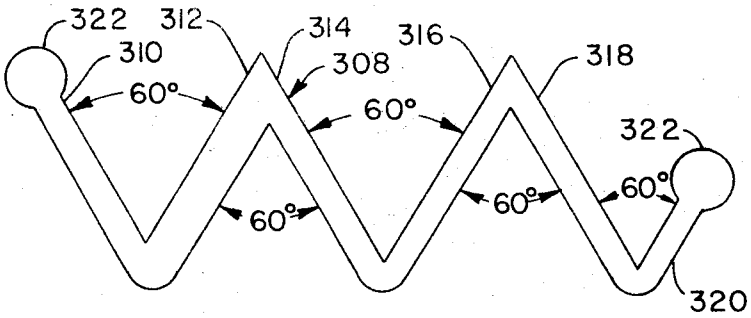
FIG. 25 is a drawing of a spinneret orifice having a single-segment body section and a single-segment wing member intersecting at one end of the single-segment body section at an angle of about 60° and a four-segment wing member intersecting at the other end of the single-segment body section and with each other at an angle of about 60°.

The spinneret orifice cross-section 308 in FIG. 25 has intersecting quadrilaterals 310, 312, 314, 316, 318, 320, with the single wider intersecting quadrilateral 312 forming a single-segment body section and the other intersecting quadrilaterals 310 and 314, 316, 318, 320 forming, respectively, a single-segment wing member (310) and a four-segment wing member (314, 316, 318, 320). The angles between the body section and the wing members are each about 60°, as illustrated in FIG. 25, and the angles between the segments of four-segment wing member are each about 60°, as also illustrated. The width of the body section is about 1.4W while the width of the wing member quadrilaterals is W. The extremities of the spinneret orifice are defined by circular bores 322.

Figure 26:
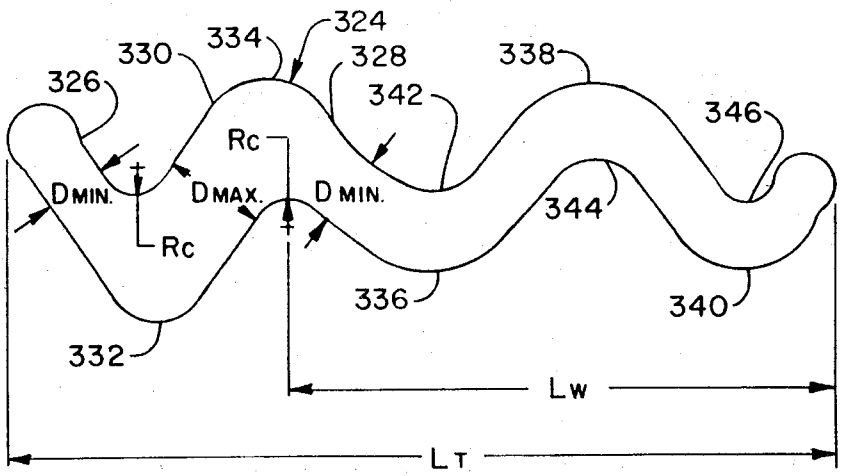
FIG. 26 illustrates the approximate configuration a filament cross-section will have when spun from the spinneret orifice shown in FIG. 25.

FIG. 26 shows the resulting filament cross-section 324, as spun from the spinneret orifice cross-section of FIG. 25, with the filament cross-section having two wing members 326, 328, which are connected, respectively, to an end of the body section 330, and two generally convex curves 332, 334, each located on the other side of the filament cross-section generally opposite one of the illustrated radius of curvatures (Rc).

The quadri-segmentation of the wing member 328 results in the formation of additional convex curves, each of which is located on the other side of the filament cross-section generally opposite, respectively, of concave curves 342, 344, 346. The convex and concave curves mentioned alternate also around the periphery of the filament cross-section.

SINGLE WING MEMBER

Figure 27:
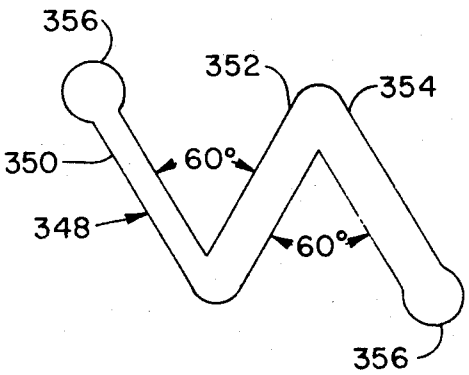
FIG. 27 is a drawing of a spinneret orifice having a dual-segment body section having an angle therebetween of about 60° and having a single-segment wing member intersecting one end of the dual-segment body section at an angle of about 60°.

The spinneret orifice cross-section 348 in FIG. 27 has intersecting quadrilaterals 350, 352, 354, with the two wider intersecting quadrilaterals 352, 354 forming a dual-segment body section and the other intersecting quadrilateral 350 forming a single-segment wing member. The angle between the body section and the wing member is about 60°, as illustrated in FIG. 27, and the angle between the two segments of the body section is about 60°, as also illustrated. The width of the body section is about 1.4W while the width of the wing member quadrilateral is W. The extremities of the spinneret orifice are defined by circular bores 356.

Figure 28:
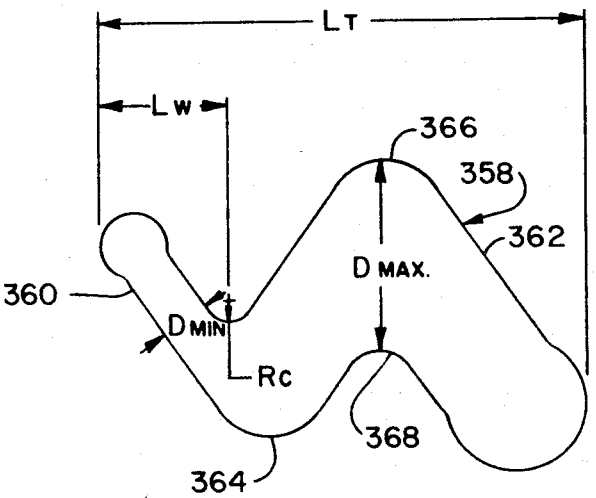
FIG. 28 illustrates the approximate configuration a filament cross-section will have when spun from the spinneret orifice shown in FIG. 27.

FIG. 28 shows the resulting filament cross-section 358, as spun from the spinneret orifice cross-section of FIG. 27, with the filament cross-section having a single-segment wing member 360, which is connected to an end of the dual-segment body section 362, and one generally convex curve 364 located on the other side of the filament cross-section generally opposite the illustrated radius of curvature (Rc).

The dual segmentation of the body section 362 results in the formation of an additional convex curve or central convex curve 366, which is located on the other side of the filament cross-section generally opposite central concave curve 368. The convex and concave curves also alternate around the periphery of the filament cross-section.

TWO WING MEMBERS

Figure 29:
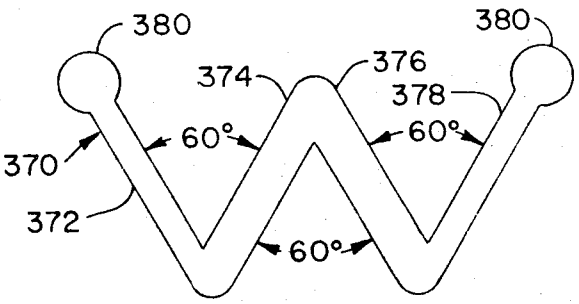
FIG. 29 is a drawing of a spinneret orifice having a dual-segment body section having an angle therebetween of about 60° and having a single-segment wing member intersecting at each end of the dual-segment body section at an angle of about 60°.

The spinneret orifice cross-section 370 in FIG. 29 has intersecting quadrilaterals 372, 374, 376, 378, with the two wider intersecting quadrilaterals 374, 376 forming a dual-segment body section and the other intersecting quadrilaterals 372 and 378 forming, respectively, two single-segment wing members. The angle between the body section and each wing member is about 60°, as illustrated in FIG. 29, and the angle between the two segments of the body section is about 60°, as also illustrated. The width of the body section is about 1.4W while the width of the wing member quadrilaterals is W. The extremities of the spinneret orifice are defined by circular bores 380.

Figure 30:
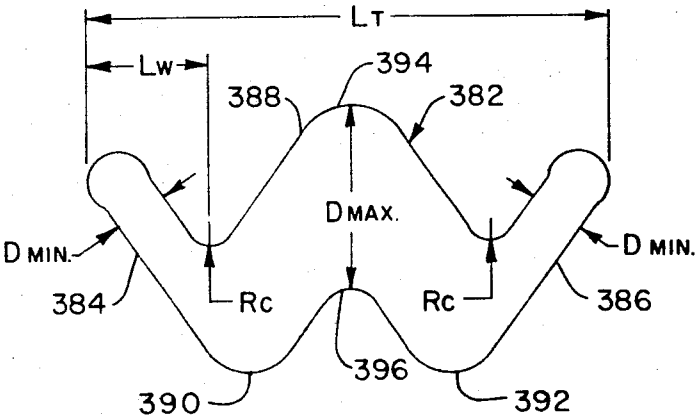
FIG. 30 illustrates the approximate configuration a filament cross-section will have when spun from the spinneret orifice shown in FIG. 29.

FIG. 30 shows the resulting filament cross-section 382, as spun from the spinneret orifice cross-section shown in FIG. 29, with the filament cross-section having two single-segment wing members 384, 386, which are connected, respectively, to an end of the body section 388, and two generally convex curves 390, 392, each located on the other side of the filament cross-section generally opposite one of the illustrated radius of curvatures (Rc).

The dual segmentation of the body section 388 also results in the formation of an additional convex curve or central convex curve 394 located on the other side of the filament cross-section generally opposite central concave curve 396. The convex and concave curves mentioned alternate around the periphery of the filament cross-section.

Figure 31:
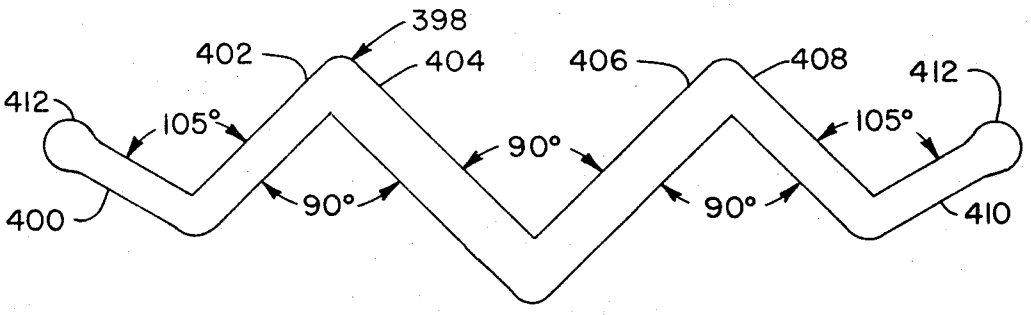
FIG. 31 is a drawing of a spinneret orifice having a dual-segment body section having an angle therebetween of about 90° and having a two-segment wing member intersecting with each other at about b 105° and at each end of the dual-segment body section at an angle of about 90°.

The spinneret orifice cross-section 398 in FIG. 31 has intersecting quadrilaterals 400, 402, 404, 406, 408, 410, with the two wider intersecting quadrilaterals 404, 406 forming a dual-segment body section and the other intersecting quadrilaterals 400, 402 and 408, 410 forming, respectively, two dual-segment wing members. The angle between the body section and each wing member is about 90°, as illustrated in FIG. 31; the angle between the two segments of the body section is about 90°; and the angle between the two segments of each wing member is about 105°. The width of the body section is about 1.4W while the width of the wing member quadrilaterals is W. The extremities of the spinneret orifice are defined by circular bores 412.

Figure 32:
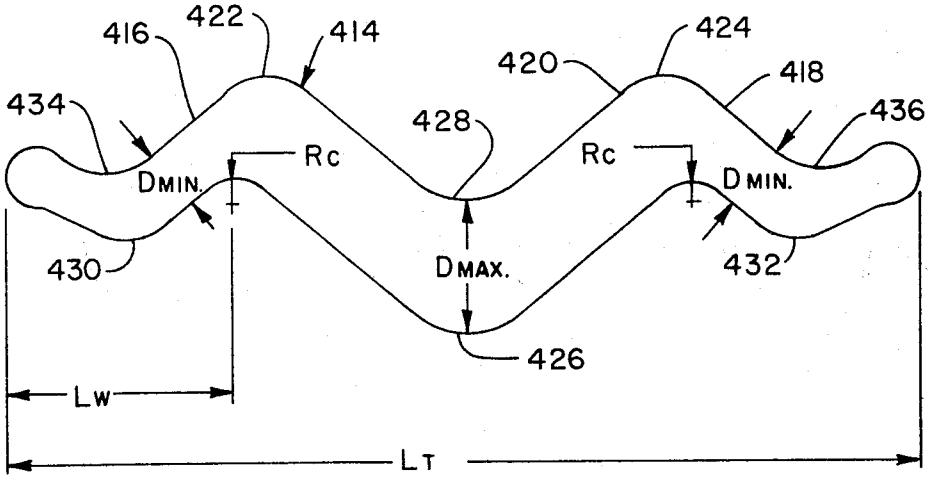
FIG. 32 illustrates the approximate configuration a filament cross-section will have when spun from the spinneret orifice shown in FIG. 31.

FIG. 32 shows the resulting filament cross-section 414, as spun from the spinneret orifice cross-section shown in FIG. 31, with the filament cross-section having two dual-segment wing members 416, 418, which are connected, respectively, to an end of the body section 420, and two generally convex curves 422, 424, each located on the other side of the filament cross-section generally opposite one of the illustrated radius of curvatures (Rc).

The dual segmentation of the body section results in the formation of an additional convex curve or central convex curve 426 located on the other side of the filament cross-section generally opposite central concave curve 428; and the dual segmentation of the wing members results in the formation of additional convex curves 430, 432, located on the other side of the filament cross-section generally opposite, respectively, concave curve 434 and concave curve 436. The convex and concave curves mentioned alternate around the periphery of the filament cross-section.

Figure 33:
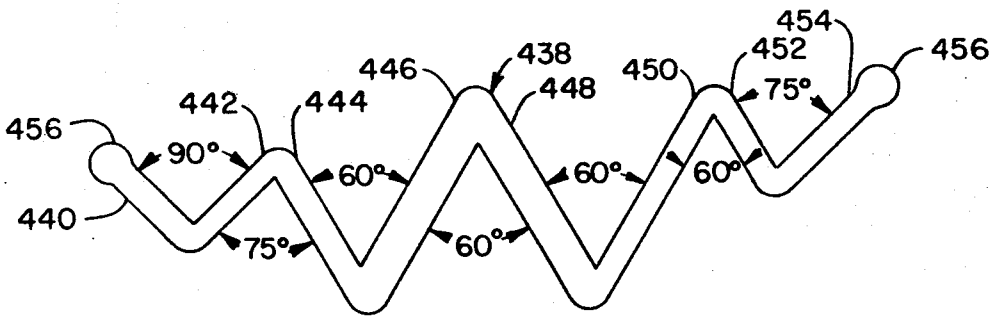
FIG. 33 is a drawing of a spinneret orifice having a dual-segment body section having an angle therebetween of about 60° and having a three-segment wing member, as viewed to the left of the body section, intersecting with each other, respectively, at about 90° and 75° and at one end of the dual-body section at an angle of about 60°, and a second three-segment wing member, as viewed to the right of the body section, intersecting with each other, respectively, at about 75° and about 60° and at the other end of the dual-segment body section at an angle of about 60°, with the lengths of the segments in one wing member differing from those in the other wing member.

The spinneret orifice cross-section 438 in FIG. 33 has intersecting quadrilaterals 440, 442, 444, 446, 448, 450, 452, 454, with the two wider intersecting quadrilaterals 446, 448 forming a dual-segment body section and the other intersecting quadrilaterals 440, 442, 446 and 450, 452, 454 forming, respectively, two tri-segment wing members. The angle between the body section and each wing member is about 60°, as illustrated in FIG. 33; the angle between the dual-segment body section is about 60°; the angle between intersecting quadrilaterals 442 and 444 is about 75°; the angle between intersecting quadrilaterals 440 and 442 is about 90°; the angle between intersecting quadrilaterals 450 and 452 is about 60°; and the angle between intersecting quadrilaterals 452 and 454 is about 75°. The width of the body section is about 1.4W while the width of the wing member quadrilaterals is W. The extremities of the spinneret orifice are defined by circular bores 456.

Figure 34:
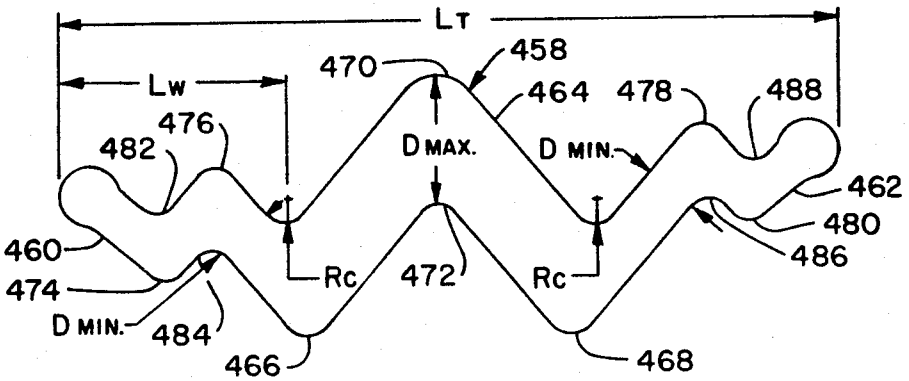
FIG. 34 illustrates the approximate configuration a filament cross-section will have when spun from the spinneret orifice shown in FIG. 33.

FIG. 34 shows the resulting filament cross-section 458, as spun from the spinneret orifice cross-section shown in FIG. 33, with the filament cross-section having two tri-segment wing members 460, 462, which are connected, respectively, to an end of the body section 464, and two generally convex curves 466, 468, each located on the other side of the filament cross-section generally opposite one of the illustrated radius of curvatures (Rc).

The dual segmentation of the body section results in the formation of an additional convex curve or central convex curve 470 located on the other side of the filament cross-section generally opposite central concave curve 472; and the tri-segmentation of the wing members results in the formation of additional convex curves 474, 476, 478, 480 located on the other side of the filament cross-section generally opposite, respectively, concave curves 482, 484, 486, 488. The convex and concave curves mentioned alternate around the periphery of the filament cross-section.

Figure 35:
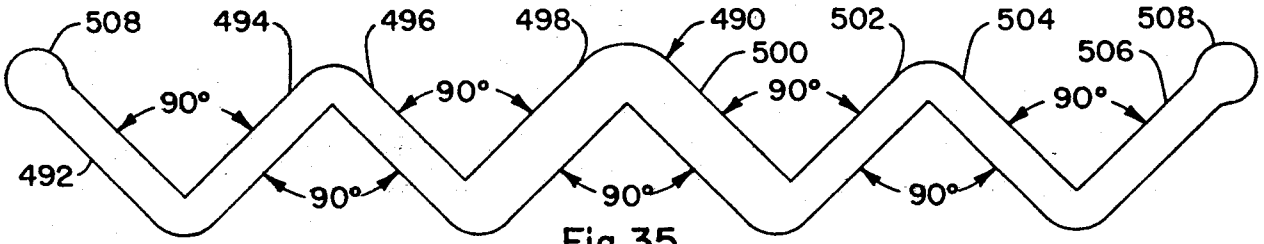
FIG. 35 is a drawing of a spinneret orifice having a dual-segment body section having an angle therebetween of about 90° and having a three-segment wing member intersecting with each other and at each end of the dual-segment body section at about 90°.

The spinneret orifice cross-section 490 in FIG. 35 has intersecting quadrilaterals 492, 494, 496, 498, 500, 502, 504, 506, with the two wider intersecting quadrilaterals 498, 500 forming a dual-segment body section and the other intersecting quadrilaterals 492, 494, 496 and 502, 504, 506 forming, respectively, two tri-segment wing members. The angle between the body section and each wing member is about 90°, as illustrated in FIG. 35; the angle between the dual-segment body section is about 90°; and the angle between each of the wing member quadrilaterals is about 90°. The width of the body section is about 1.4W while the width of the wing member quadrilaterals is W. The extremities of the spinneret orifice are defined by circular bores 508.

Figure 36:
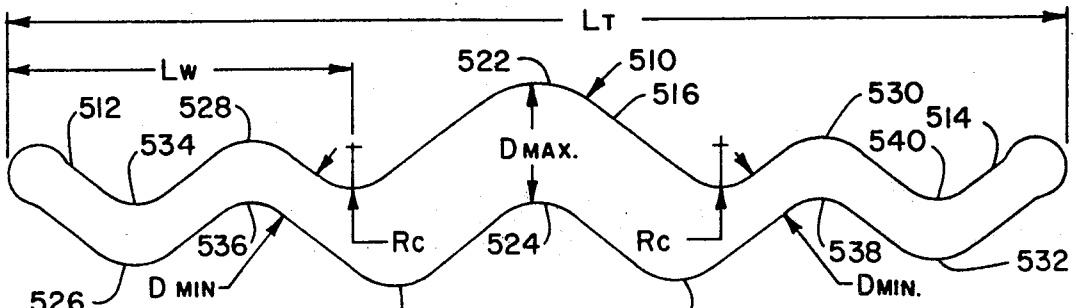
FIG. 36 illustrates the approximate configuration a filament cross-section will have when spun from the spinneret orifice shown in FIG. 35.

FIG. 36 shows the resulting filament 510, as spun from the spinneret orifice cross-section shown in FIG. 35, with the filament cross-section having two tri-segment wing members 512, 514, which are connected, respectively, to an end of the body section 516, and two generally convex curves 518, 520, each located on the other side of the filament cross-section generally opposite one of the illustrated radius of curvatures (Rc).

The dual segmentation of the body section results in the formation of an additional convex curve or central convex curve 522 located on the other side of the filament cross-section generally opposite central concave curve 524; and the tri-segmentation of the wing members results in the formation of additional convex curves 526, 528, 530, 532 located on the other side of the filament cross-section generally opposite, respectively, concave curves 534, 536, 538, 540. The convex and concave curves mentioned alternate around the periphery of the filament cross-section.

Figure 37:
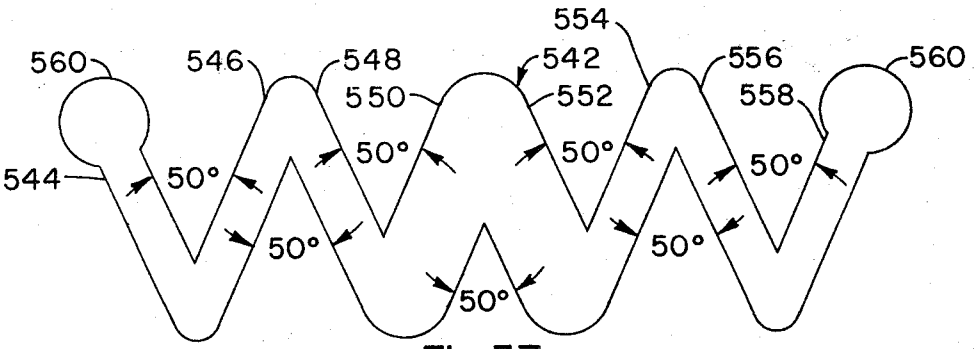
FIG. 37 is a drawing of a spinneret orifice having a dual-segment body section having an angle therebetween of about 50° and having a three-segment wing member intersecting with each other and at each end of the dual-segment body section at about 50°.

The spinneret orifice cross-section 542 in FIG. 37 has intersecting quadrilaterals 544, 546, 548, 550, 552, 554, 556, 558, with the two wider intersecting quadrilaterals 550, 552 forming a dual-segment body section and the other intersecting quadrilaterals 544, 546, 548 and 554, 556, 558 forming, respectively, two tri-segment wing members. The angle between the body section and each wing member is about 50°; and the angle between each of the wing member quadrilaterals is about 50°. The width of the body section is about 2W while the width of the wing member quadrilaterals is W. The extremities of the spinneret orifice are defined by circular bores 560.

Figure 38:
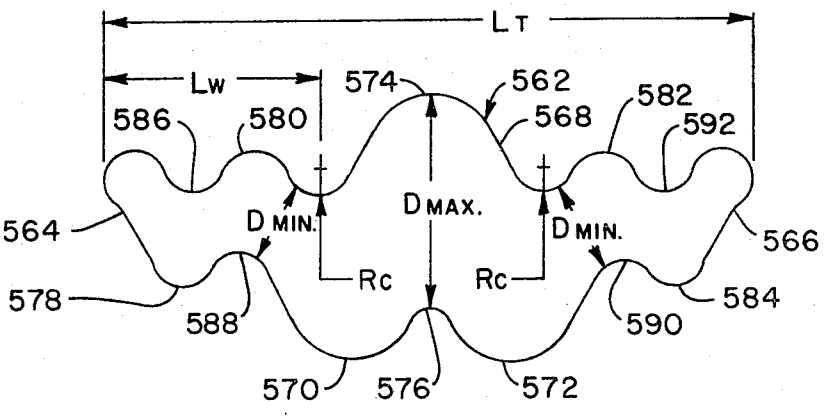
FIG. 38 illustrates the approximate configuration a filament cross-section will have when spun from the spinneret orifice shown in FIG. 37.

FIG. 38 shows the resulting filament cross-section 562, as spun from the spinneret orifice cross-section shown in FIG. 37, with the filament cross-section having two tri-segment wing members 564, 566, which are connected, respectively, to an end of the body section 568, and two generally convex curves 570, 572, each located on the other side of the filament cross-section generally opposite one of the illustrated radius of curvatures (Rc).

The dual segmentation of the body section results in the formation of an additional convex curve or central convex curve 574 located on the other side of the filament cross-section generally opposite central concave curve 576; and the tri-segmentation of the wing members results in the formation of additional convex curves 578, 580, 582, 584 located on the other side of the filament cross-section generally opposite, respectively, concave curves 586, 588, 590, 592. The convex and concave curves mentioned alternate around the periphery of the filament cross-section.

Figure 39:
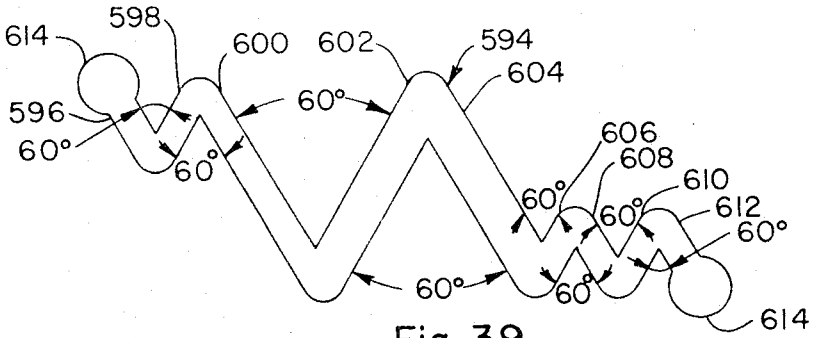
FIG. 39 is a drawing of a spinneret orifice having a dual-segment body section having an angle therebetween of about 60° and having a three-segment wing member, as viewed to the left of the body section, intersecting with each other and at one end of the body section at an angle of about 60°, and having a four-segment wing member, as viewed to the right of the body section, intersecting with each other and at the other end of the body section at an angle of about 60°, with the lengths of the segments in one wing member differing from those in the other wing member.

The spinneret orifice cross-section 594 in FIG. 39 has intersecting quadrilaterals 596, 598, 600, 602, 604, 606, 608, 610, 612, with the two wider intersecting quadrilaterals 602, 604 forming a dual-segment body section; intersecting quadrilaterals 596, 598, 600 forming a tri-segment wing member; and intersecting quadrilaterals 606, 608, 610, 612 forming a quadri-segment wing member. The angle between the body section and each wing member is about 60°, as illustrated in FIG. 39; and the angle between each of the segments of the wing members is also about 60°. The width of the body section is about 1.4W while the width of the wing member quadrilaterals is W. The extremities of the spinneret orifice are defined by circular bores 614.

Figure 40:
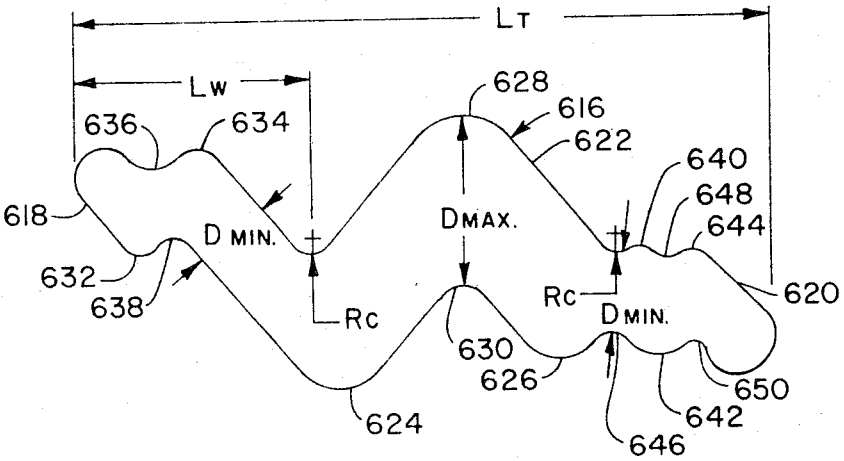
FIG. 40 illustrates the approximate configuration a filament cross-section will have when spun from the spinneret orifice shown in FIG. 39.

FIG. 40 shows the resulting filament cross-section 616, as spun from the spinneret orifice cross-section shown in FIG. 39, with the filament cross-section having a tri-segment wing member 618 and a quadri-segment wing member 620, which are connected, respectively, to an end of the body section 622, and two generally convex curves 624, 626, each located on the other side of the filament cross-section generally opposite one of the illustrated radius of curvatures (Rc).

The dual segmentation of the body section results in the formation of an additional convex curve or central convex curve 628 located on the other side of the filament cross-section generally opposite central concave curve 630; the tri-segmentation of wing member 618 results in the formation of additional convex curves 632, 634 located on the other side of the filament cross-section generally opposite, respectively, concave curves 636, 638; and the quadri-segmentation of wing member 620 results in the formation of additional convex curves 640, 642, 644 located on the other side of the filament cross-section generally opposite, respectively, concave curves 646, 648, 650. The convex and concave curves mentioned alternate around the periphery of the filament cross-section.

Figure 41:
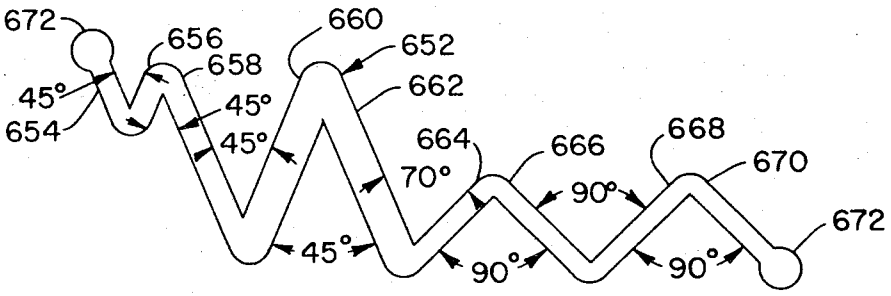
FIG. 41 is a drawing of a spinneret orifice having a dual-segment body section having an angle therebetween of about 45° and having a three-segment wing member, as viewed to the left of the body section, intersecting with each other and at one end of the body section at an angle of about 45°, and having a four-segment wing member, as viewed to the right of the body section, intersecting with each other at an angle of about 90° and at the other end of the body section at an angle of about 70°, with the lengths of the segments in one wing member differing from those in the other wing member.

The spinneret orifice cross-section 652 in FIG. 41 has intersecting quadrilaterals 654, 656, 658, 660, 662, 664, 666, 668, 670, with the two wider intersecting quadrilaterals 660, 662 forming a dual-segment body section; intersecting quadrilaterals 654, 656, 658 forming a tri-segment wing member; and intersecting quadrilaterals 664, 666, 668, 670 forming a quadri-segment wing member. The angle between the body section and the tri-segment wing member is about 45°, and the angle between the body section and the quadri-segment wing member is about 70°, as illustrated in FIG. 41; and the angle between each of the segments of the tri-segment wing member is about 45° and the angle between each of the segments of the quadri-segment wing member is about 90°. The width of the body section is about 1.4W while the width of the wing member quadrilaterals is W. The extremities of the spinneret orifice cross-section are defined by circular bores 672.

Figure 42:
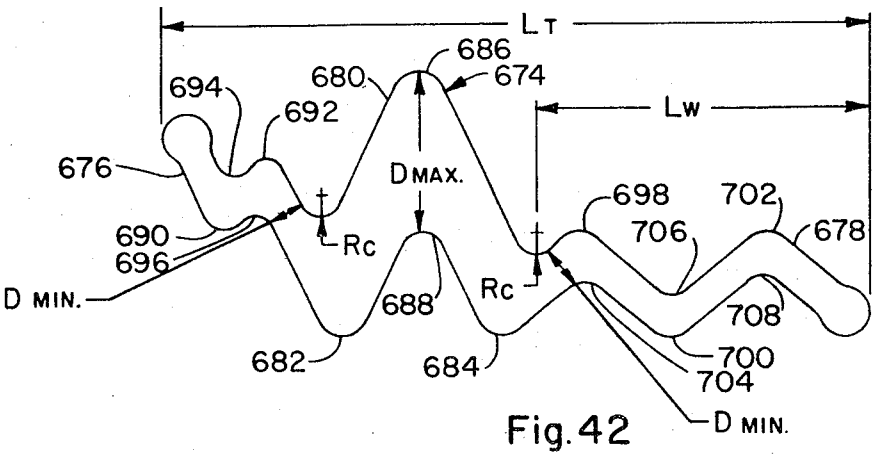
FIG. 42 illustrates the approximate configuration a filament cross-section will have when spun from the spinneret orifice shown in FIG. 41.

FIG. 42 shows the resulting filament cross-section 674, as spun from the spinneret orifice cross-section shown in FIG. 41, with the filament cross-section also having a tri-segment wing member 676 and a quadri-segment wing member 678, which are connected, respectively, to an end of the body section 680, and two generally convex curves 682, 684, each located on the other side of the filament cross-section generally opposite one of the illustrated radius of curvatures (Rc).

The dual segmentation of the body section results in the formation of an additional convex curve or central convex curve 686 located on the other side of the filament cross-section generally opposite central concave curve 688; the tri-segmentation of wing member 676 results in the formation of additional convex curves 690, 692 located on the other side of the filament cross-section generally opposite, respectively, concave curves 694, 696; and the quadri-segmentation of wing member 678 results in the formation of additional convex curves 698, 700, 702 located on the other side of the filament cross-section generally opposite, respectively, concave curves 704, 706, 708. The convex and concave curves mentioned alternate around the periphery of the filament cross-section.

Figure 43:
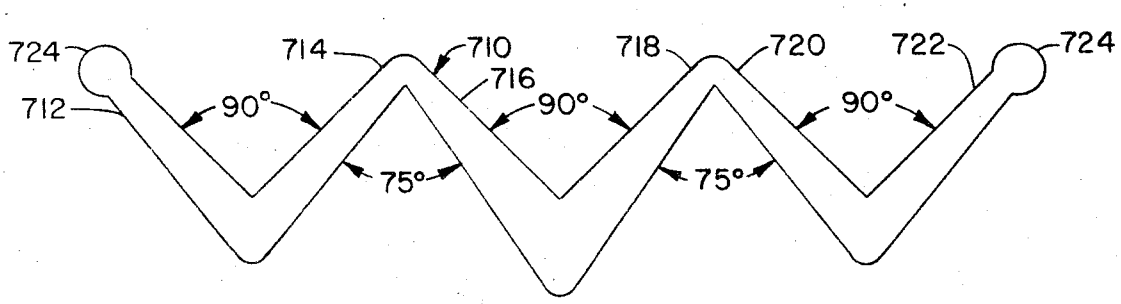
FIG. 43 is a drawing of a spinneret orifice having a tapering dual-segment body section having an angle therebetween of about 90° and having a tapering two-segment wing member intersecting with each other at an angle of about 90° and with the body section at an angle of about 75°.

The spinneret orifice cross-section 710 in FIG. 43 has tapered intersecting quadrilaterals 712, 714, 716, 718, 720, 722, with the two wider tapered intersecting quadrilaterals 716, 718 forming a dual-segment body section; and tapered intersecting quadrilaterals 712, 714 and 720, 722 forming, respectively, two dual-segment wing members. The angle between the body section and each wing member is about 75°, and the angle between wing member segments is about 90°, as illustrated in FIG. 43. The width of the body section at its widest point is about 1.4W while the width of the wing member quadrilaterals at their corresponding widest point is W. The extremities of the spinneret orifice cross-section are defined by circular bores 724.

Figure 44:
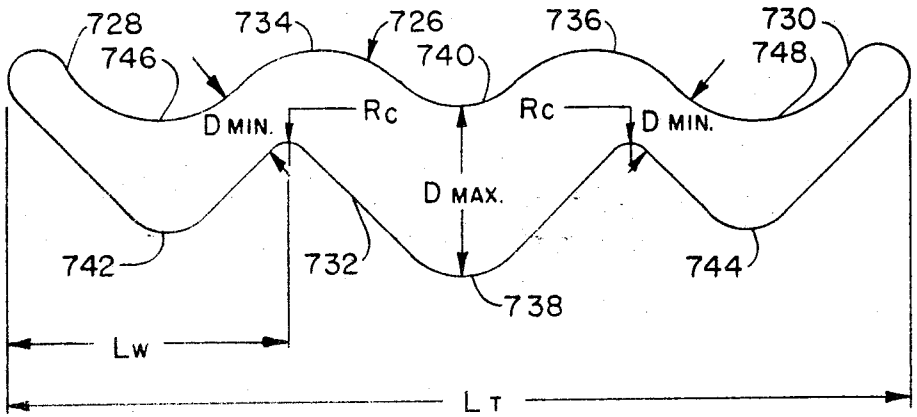
FIG. 44 illustrates the approximate configuration a filament cross-section will have when spun from the spinneret orifice shown in FIG. 43.

FIG. 44 shows the resulting filament cross-section 726, as spun from the spinneret orifice cross-section shown in FIG. 43, with the filament cross-section having, respectively, dual-segment wing members 728, 730, which are each connected to an end of the body section 732, and two generally convex curves 734, 736, each located on the other side of the filament cross-section generally opposite one of the illustrated radius of curvatures (Rc).

The dual segmentation of the body section results in the formation of an additional convex curve or central convex curve 738 located on the other side of the filament cross-section generally opposite central concave curve 740; and the dual segmentation of the wing members 728, 730 results in the formation of additional convex curves 742, 744 located on the other side of the filament cross-section generally opposite, respectively, concave curves 746, 748. The convex and concave curves mentioned alternate around the periphery of the filament cross-section.

SINGLE WING MEMBER

Figure 45:
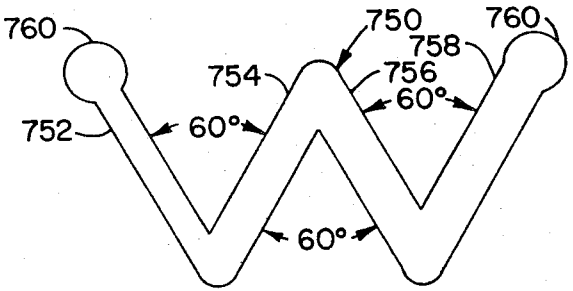
FIG. 45 is a drawing of a spinneret orifice having a three-segment body section intersecting with each other at an angle of about 60° and having a single-segment wing member intersecting at one end of the body section at an angle of about 60°.

The spinneret orifice cross-section 750 in FIG. 45 has intersecting quadrilaterals 752, 754, 756, 758, with the three wider intersecting quadrilaterals 754, 756, 758 forming a tri-segment body section; and intersecting quadrilateral 754 forming a single-segment wing member. The angle between the body section and the wing member is about 60°, and the angle between each segment of the body section is about 60°, as illustrated in FIG. 45. The width of the body section is about 1.4W while the width of the wing member is W. The extremities of the spinneret orifice cross-section are defined by circular bores 760.

Figure 46:
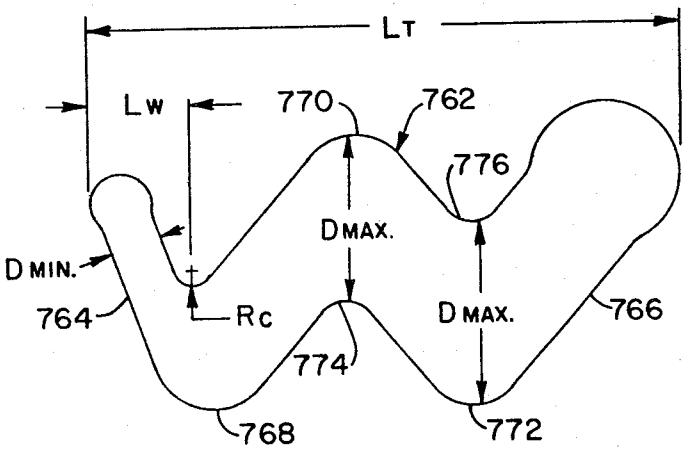
FIG. 46 illustrates the approximate configuration a filament cross-section will have when spun from the spinneret orifice shown in FIG. 45.

FIG. 46 shows the resulting filament cross-section 762, as spun from the spinneret orifice cross-section shown in FIG. 45, with the filament cross-section having a single segment wing member 764 connected to an end of the tri-segment body section 766, and a single generally convex curve 768 located on the other side of the filament cross-section generally opposite the single illustrated radius of curvature (Rc).

The tri-segmentation of the body section results in the formation of additional convex curves or central convex curves 770, 772 located on the other side of the filament cross-section generally opposite, respectively, central concave curves 774, 776. The convex and concave curves mentioned alternate around the periphery of the filament cross-section.

TWO WING MEMBERS

Figure 47:
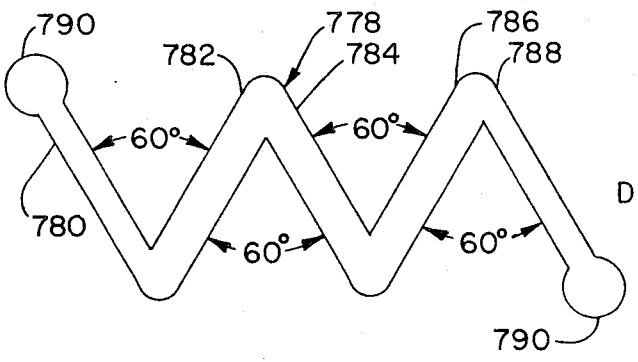
FIG. 47 is a drawing of a spinneret orifice having a three-segment body section intersecting with each other at an angle of about 60° and having a single-segment wing member intersecting at each end of the body section at an angle of about 60°.

The spinneret orifice cross-section 778 in FIG. 47 has intersecting quadrilaterals 780, 782, 784, 786, 788, with the three wider intersecting quadrilaterals 782, 784, 786 forming a tri-segment body section; and intersecting quadrilaterals 780 and 788 forming, respectively, two single-segment wing members. The angle between the body section and each wing member is about 60°, and the angle between each segment of the body section is about 60°. The width of the body section is about 1.4W while the width of the wing member quadrilaterals is W. The extremities of the spinneret orifice cross-section are defined by circular bores 790.

Figure 48:
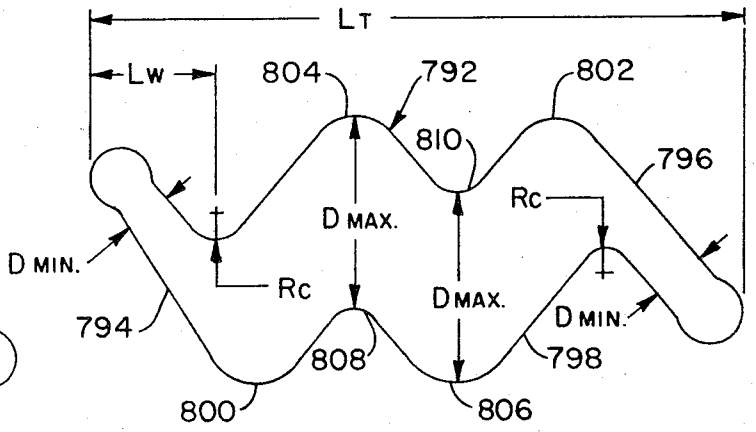
FIG. 48 illustrates the approximate configuration a filament cross-section will have when spun from the spinneret orifice shown in FIG. 49.

FIG. 48 shows the resulting filament cross-section 792, as spun from the spinneret orifice cross-section shown in FIG. 47, with the filament cross-section having single-segment wing members 794, 796, which are each connected to an end of the body section 798, and two generally convex curves 800, 802, each located on the other side of the filament cross-section generally opposite one of the illustrated radius of curvatures (Rc).

The tri-segmentation of the body section results in the formation of additional convex curves or central convex curves 804, 806 located on the other side of the filament cross-section generally opposite, respectively, central concave curves 808, 810. The convex and concave curves mentioned alternate around the periphery of the filament cross-section.

SINGLE WING MEMBER

Figure 49:
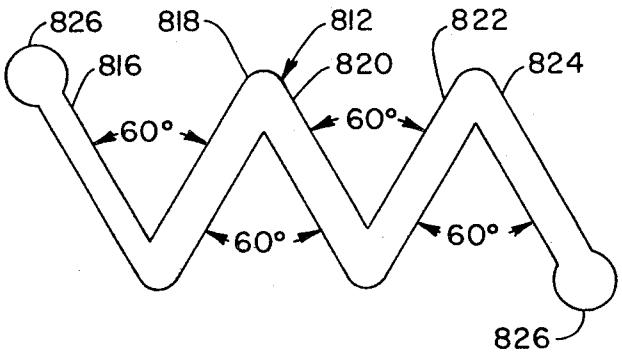
FIG. 49 is a drawing of a spinneret orifice having a four-segment body section intersecting with each other at an angle of about 60° and having a single-segment wing member intersecting at one end of the body section at an angle of about 60°.

The spinneret orifice cross-section 812 in FIG. 49 has intersecting quadrilaterals 814, 816, 818, 820, 822, 824, with the four wider intersecting quadrilaterals 818, 820, 822, 824 forming a quadri-segment body section, and intersecting quadrilateral 814 forming a single-segment wing member. The angle between the body section and the single-segment wing member is about 60°, and the angle between each of the body section segments is about 60°, as illustrated in FIG. 49. The width of the body section is about 1.4W while the width of the wing member quadrilateral is W. The extremities of the spinneret orifice cross-section are defined by circular bores 826.

Figure 50:
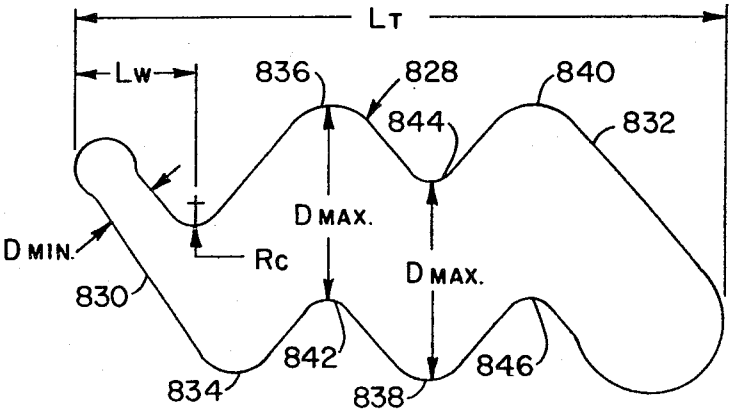
FIG. 50 illustrates the approximate configuration a filament cross-section will have when spun from the spinneret orifice shown in FIG. 50.

FIG. 50 shows the resulting filament cross-section 828, as spun from the spinneret orifice cross-section shown in FIG. 49, with the filament cross-section having a single segment wing member 830 connected to an end of the quadri-segment body section 832, and a single generally convex curve 834 located on the other side of the filament cross-section generally opposite the illustrated radius of curvature (Rc).

The quadri-segmentation of the body section results in the formation of additional convex curves or central convex curves 836, 838, 840 located on the other side of the filament cross-section generally opposite, respectively, central concave curves 842, 844, 846. The convex and concave curves mentioned alternate around the periphery of the filament cross-section.

TWO WING MEMBERS

Figure 51:
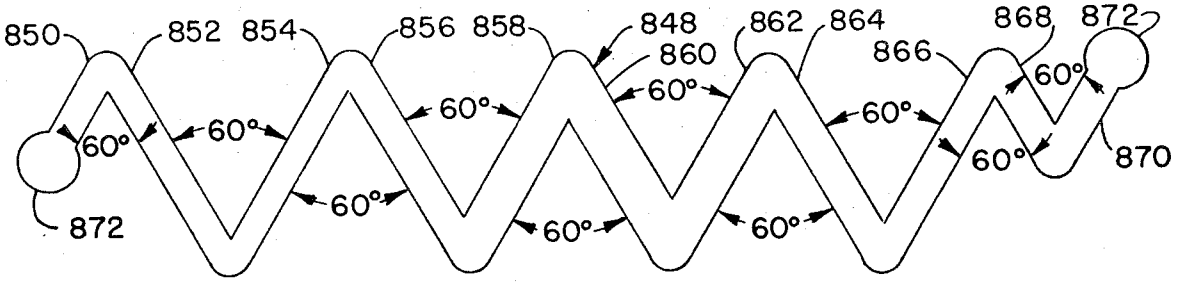
FIG. 51 is a drawing of a spinneret orifice having a three-segment body section intersecting with each other at an angle of about 60° and having two four-segment wing members each intersecting at an end of the body section at an angle of about 60°, and each wing member segment intersecting with another wing member segment also at an angle of about 60°.

The spinneret orifice cross-section 848 in FIG. 51 has intersecting quadrilaterals 850, 852, 854, 856, 858, 860, 862, 864, 866, 868, 870, with the three wider intersecting quadrilaterals 858, 860, 862 forming a tri-segment body section, and intersecting quadrilaterals 850, 852, 854, 856, and 864, 866, 868, 870 forming, respectively, two quadri-segment wing members. The angle between the body section and each wing member is about 60°, and the angle between each wing member segment is also about 60°, as illustrated in FIG. 51. The width of the body section is about 1.4W while the width of the wing members is W. The extremities of the spinneret orifice are defined by circular bores 872.

Figure 52:
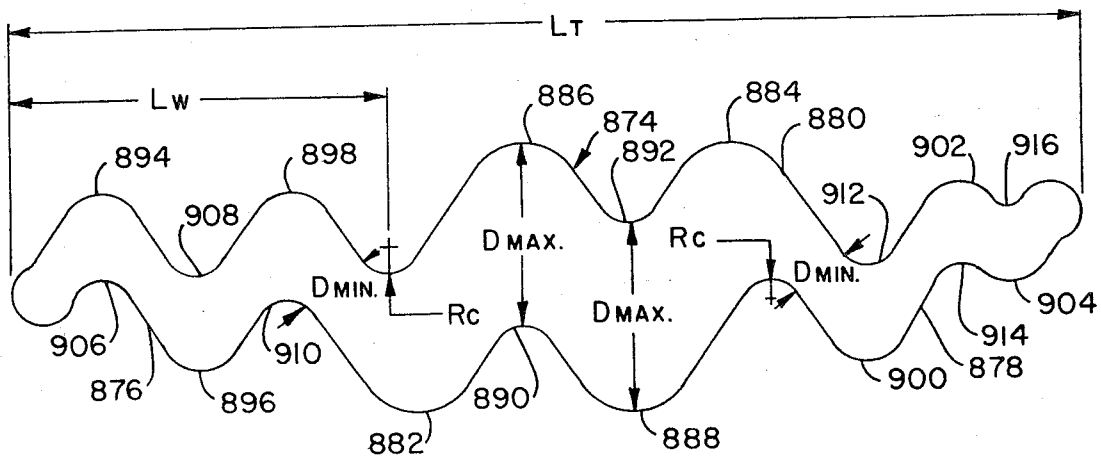
FIG. 52 illustrates the approximate cross-section a filament cross-section will have when spun from the spinneret orifice shown in FIG. 51.

FIG. 52 shows the resulting filament cross-section 874, as spun from the spinneret orifice cross-section shown in FIG. 51, with the filament cross-section having quadri-segment wing members 876, 878 each connected to an end of the tri-segment body section 880, and two generally convex curves 882, 884 located on the other side of the filament cross-section generally opposite one of the illustrated radius of curvatures (Rc).

The tri-segmentation of the body section results in the formation of additional convex curves or central convex curves 886, 888 located on the other side of the filament cross-section generally opposite, respectively, central concave curves 890, 892; and the quadri-segmentation of each of the wing members results in the formation of additional convex curves 894, 896, 898, 900, 902, 904 located on the other side of the filament cross-section generally opposite, respectively, concave curves 906, 908, 910, 912, 914, 916. The convex and concave curves mentioned alternate around the periphery of the filament cross-section.

Figure 53:
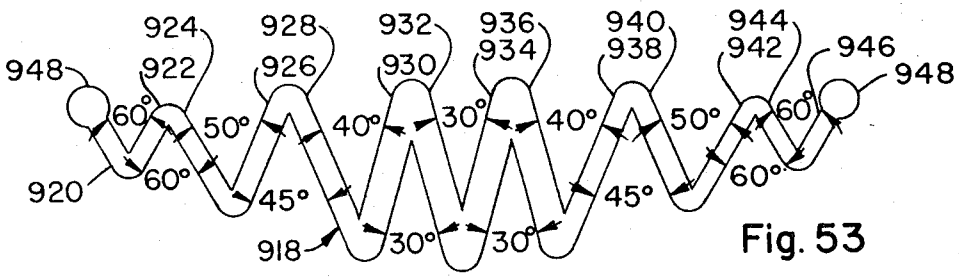
FIG. 53 is a drawing of a spinneret orifice having a four-segment body section intersecting with each other at an angle of about 30° and having two five-segment wing members each intersecting at an end of the body section at an angle of about 40°, and the five segments of each wing member intersecting with each other from the outer end toward the body section, respectively, at angles of about 60°, 60°, 50° and 45°.

The spinneret orifice cross-section 918 in FIG. 53 has intersecting quadrilaterals 920, 922, 924, 926, 928, 930, 932, 934, 936, 938, 940, 942, 944, 946 with the four wider intersecting quadrilaterals 920, 922, 924, 926, 928 and 938, 940, 942, 944, 946 forming respectively, two quinti-segment wing members. The angle between the body section and each wing member is about 40°; the angles between the wing member segments (starting to the left of FIG. 53) for each wing member are, respectively, about 60°, 60°, 50°, 45° and about 45°, 50°, 60°, 60°; and the angles between the body section segments are 30°, as illustrated in FIG. 53. The width of the body section is about 1.4W while the width of the wing members is W. The extremities of the spinneret orifice are defined by circular bores 948.

Figure 54:
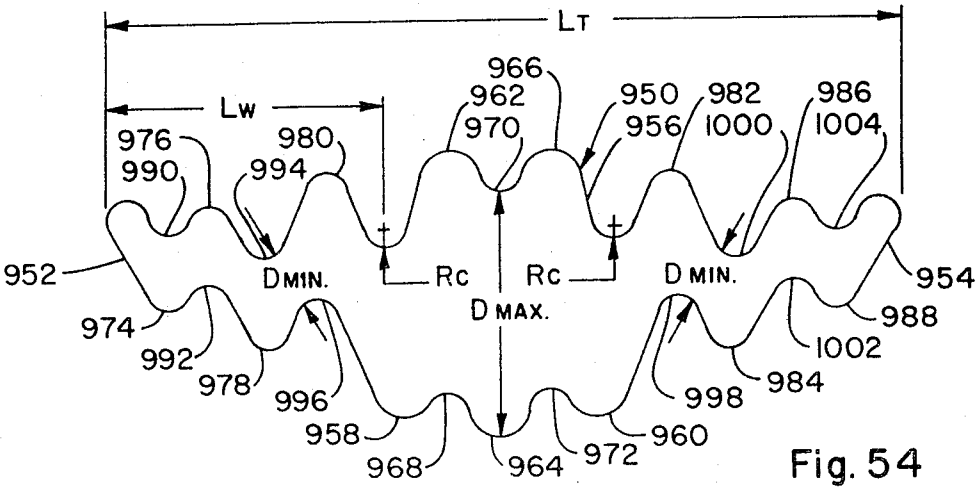
FIG. 54 illustrates the approximate configuration a filament cross-section will have when spun from the spinneret orifice shown in FIG. 53.

FIG. 54 shows the resulting filament cross-section 950, as spun from the spinneret orifice cross-section shown in FIG. 53, with the filament cross-section having quinti-segment wing members 952, 954, each connected to an end of the quadri-segment body section 956, and two generally convex curves 958, 960 located on the other side of the filament cross-section generally opposite one of the illustrated radius of curvatures (Rc).

The quadri-segmentation of the body section results in the formation of additional convex curves or central convex curves 962, 964, 966 located on the other side of the filament cross-section generally opposite, respectively, central concave curves 968, 970, 972; and the quinti-segmentation of each of the wing members results in the formation of additional convex curves 974, 976, 978, 980, 982, 984, 986, 988 located on the other side of the filament cross-section generally opposite, respectively, concave curves 990, 992, 994, 996, 998, 1000, 1002, 1004. The convex and concave curves mentioned alternate around the periphery of the filament cross-section.

Figure 55:
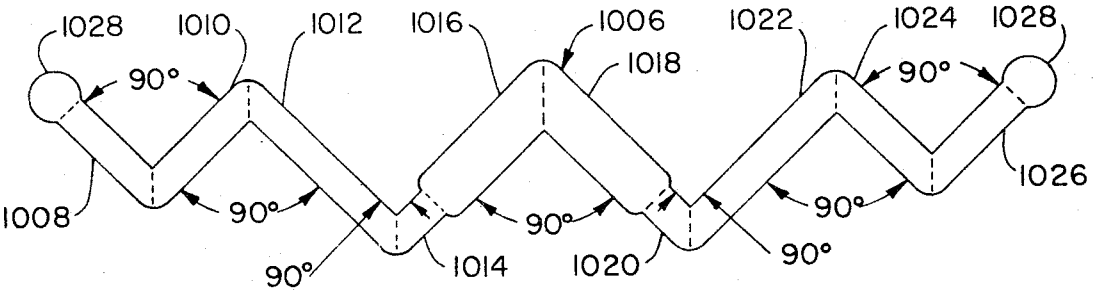
FIG. 55 is a drawing of a spinneret orifice having an enlarged two-segment body section intersecting with each other at an angle of about 90° and having two four-segment wing members each intersecting at each end of the body section at an angle of about 90°, and each wing member segment intersecting with an adjacent wing member segment at an angle of about 90°.

The spinneret orifice cross-section 1006 in FIG. 55 has intersecting quadrilaterals 1008, 1010, 1012, 1014, 1016, 1018, 1020, 1022, 1024, 1026, with the wider intersecting quadrilaterals 1016, 1018 forming a dual-segment body section, and intersecting quadrilaterals 1008, 1010, 1012, 1014 and 1020, 1022, 1024, 1026 forming, respectively, two quadri-segment wing members. The angle between the body section and each wing member is about 90°; and the angles between the segments of the wing members are each about 90°, as illustrated in FIG. 55. The width of the body section is about 1.4W while the width of the wing members is W. The extremities of the spinneret orifice are defined by circular bores 1028.

Figure 56:
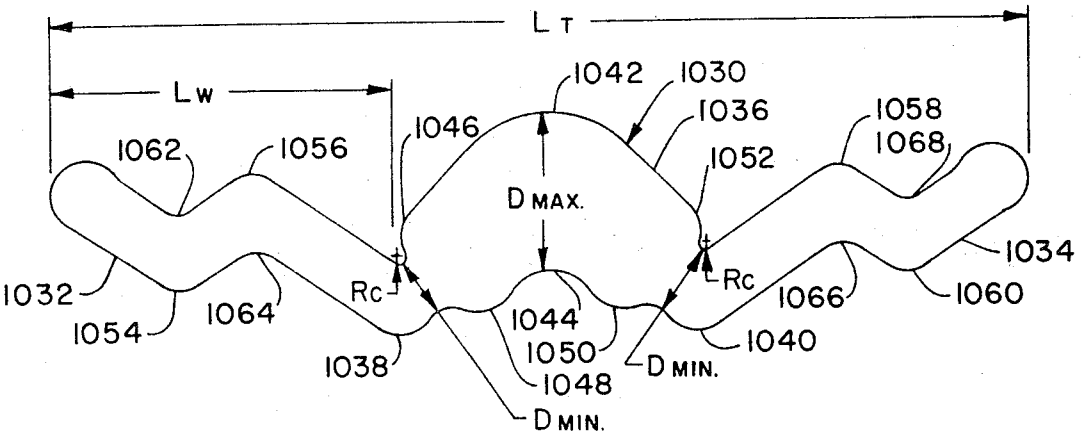
FIG. 56 illustrates the approximate cross-section a filament cross-section will have when spun from the spinneret orifice shown in FIG. 55.

FIG. 56 shows the resulting filament cross-section 1030, as spun from the spinneret orifice cross-section shown in FIG. 55, with the filament cross-section having quadri-segment wing members 1032, 1034, each connected to an end of the dual-segment body section 1036, and two generally convex curves 1038, 1040 located on the other side of the filament cross-section generally opposite one of the illustrated radius of curvatures (Rc).

The dual segmentation of the body section results in the formation of an additional convex curve or central convex curve 1042 located on the other side of the filament cross-section generally opposite concave curve 1044, and the shouldered formation of the body section adjacent the connection of each wing member results in the formation of further additional convex curves 1046, 1048 and 1050, 1052, as illustrated in FIG. 56. As further illustrated, the quadri-segmentation of the wing members results in the formation of additional convex curves 1054, 1056, 1058, 1060 located on the other side of the filament cross-section generally opposite, respectively, concave curves 1062, 1064, 1066, 1068. The convex and concave curves mentioned alternate around the periphery of the filament cross-section.

FOUR WING MEMBERS

Figure 57:
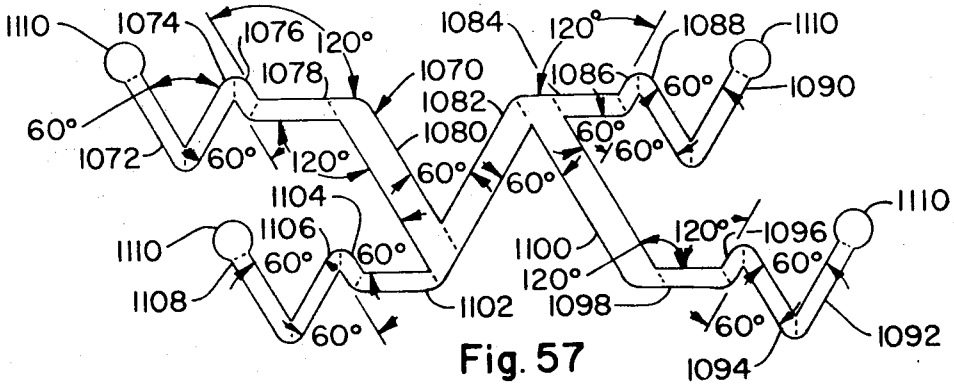
FIG. 57 is a drawing of a spinneret orifice having a three-segment body section intersecting with each other at an angle of about 60° and four wing members, each, for instance, being in four segments and the segments intersecting with each other at an angle of about 60° with two diagonally opposite wing members intersecting the body section at an angle of about 120° and the other diagonally opposite two wing members intersecting the body section at an angle of about 60°.

The spinneret orifice cross-section 1070 in FIG. 57 has intersecting quadrilaterals 1072, 1074, 1076, 1078, 1080, 1082, 1084, 1086, 1088, 1090, 1092, 1094, 1096, 1098, 1100, 1102, 1104, 1106, 1108. The three wider intersecting quadrilaterals 1080, 1082, 1100 form a tri-segment body section. Intersecting quadrilaterals 1071, 1073, 1076, 1078; 1084, 1086, 1088, 1090; 1092, 1094, 1096, 1098; and 1102, 1104, 1106, 1108 form, respectively, first, second, third, fourth or four quadri-segment wing members. The angle between the body section and each of the first and third wing members is about 120°, and the angle between the body section and each of the second and fourth wing members is about 60°, as illustrated in FIG. 57. The angle between each of the body section segments is about 60°; and the angles between the segments of each wing member are from the body section toward the outer extremity, respectively, about 120°, 60°, and 60°. The width of the body section is about 1.4W while the width of the wing members is W. The extremities of the spinneret orifice are defined by circular bores 1110.

Figure 58:
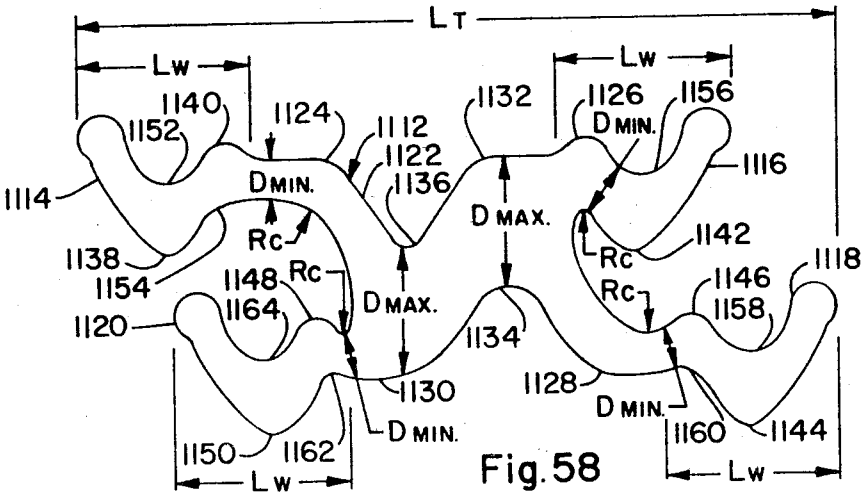
FIG. 58 illustrates the approximate cross-section a filament cross-section will have when spun from the spinneret orifice shown in FIG. 57.

FIG. 58 shows the resulting filament cross-section 1112, as spun from the spinneret orifice cross-section shown in FIG. 57, with the filament cross-section having quadri-segment wing members 1114, 1116, 1118, 1120, each connected to an end of the tri-segment body section 1122, and four generally convex curves 1124, 1126, 1128, 1130 located on the other side of the filament cross-section generally opposite one of the illustrated radius of curvatures (Rc).

The tri-segmentation of the body section results in the formation of an additional convex curve or central convex curve 1132 located on the other side of the filament cross-section generally opposite central concave curve 1134. There is at least one other concave or central concave curve 1136 which is offset from the other central concave curve, but the convex curve opposite it blends into and with the previously identified convex curve 1130 so that it becomes a matter of choice whether to separately identify it or the convex portion and the latter has already been identified as convex curve 1130 which is located generally opposite one of the radius of curvatures (Rc). The quadri-segmentation of each of the wing members results in the formation of additional convex curves 1138, 1140, 1142, 1144, 1146, 1148, 1150 located on the other side of the filament cross-section generally opposite, respectively, concave curves 1152, 1154 [which blends into and with the adjacent radius of curvatures (Rc)], 1156, 1158, 1160, 1162, 1164. The convex and concave curves mentioned alternate around the periphery of the filament cross-section.

The invention has been described in detail with particular reference to preferred embodiments thereof, but it will be understood that variations and modifications can be effected within the spirit and scope of the invention.

I claim:

1. A spinneret defining at least one spinneret orifice the planar cross-section of which defines intersecting quadrilaterals in connected series with the L/W of each quadrilateral varying from 2 to 10, the improvement being that one or more of the defined quadrilaterals is or are characterized by its or their width being greater than the width of the remaining quadrilateral(s), with the wider quadrilateral(s) defining body section(s) and with the remaining quadrilateral(s) defining wing members.

2. A spinneret as defined in claim 1 wherein the number of intersecting quadrilaterals may vary from 2 to 14, said body section quadrilaterals may vary from 1 to 4 and said wing member quadrilaterals may vary from 1 to 5.

3. A spinneret as defined in claim 2 wherein the number of said intersecting quadrilaterals is 8, the number of said body section quadrilaterals is 2 and the number of said wing member quadrilaterals is 3.

4. A spinneret as defined in claim 1 wherein the angle $\theta_B$ between adjacent body section quadrilaterals may vary from about 30° to about 90°, and the angle $\theta_W$ between adjacent wing member quadrilaterals may vary from about 45° to about 150°.

5. A spinneret as defined in claim 4 wherein said angle $\theta_B$ may vary from about 45° to about 60° and said angle $\theta_W$ may vary from about 45° to about 90°.

6. A spinneret as defined in claim 1 wherein the $L_B/W_B$ of the body section quadrilaterals may vary in proportional relationship from about 1.5 to about 10, and the $L_W/W_W$ of the wing member quadrilaterals may vary from about 3 to about 10.

7. A spinneret as defined in claim 6 wherein said $L_B/W_B$ may vary in proportional relationship from about 2 to about 5, and said $L_W/W_W$ may vary from about 4 to about 6.

8. A spinneret as defined in claim 1 wherein each end of said connected series of quadrilaterals in said spinneret orifice defines a circular bore of predetermined diameter.

9. A spinneret as defined in claim 8 wherein the diameter D of said circular bore divided by the width of the wing member $W_W$ may vary in proportional relationship from about 1.5 to about 2.5.

10. A spinneret as defined in claim 9 wherein the ratio $D/W_W$ may be 2.

* * * * *